US012264904B2

(12) United States Patent
Bowmar et al.

(10) Patent No.: US 12,264,904 B2
(45) Date of Patent: Apr. 1, 2025

(54) VARIABLE CUTTING DIAMETER ARROWHEAD

(71) Applicant: Bowmar Archery LLC, Des Moines, IA (US)

(72) Inventors: Joshua Bowmar, Ankeny, IA (US); David Houser, Creekside, PA (US)

(73) Assignee: Bowmar Archery LLC, Des Moines, IA (US)

( * ) Notice: Subject to any disclaimer, the term of this patent is extended or adjusted under 35 U.S.C. 154(b) by 0 days.

(21) Appl. No.: 18/799,479

(22) Filed: Aug. 9, 2024

(65) Prior Publication Data

US 2025/0052548 A1 Feb. 13, 2025

Related U.S. Application Data

(60) Provisional application No. 63/531,968, filed on Aug. 10, 2023.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | |
|---|---|---|---|
| 1,318,858 | A | 10/1919 | Frick |
| 1,330,291 | A | 2/1920 | James et al. |
| 2,725,656 | A | 12/1955 | Schmidt |
| 3,036,396 | A | 5/1962 | Swails |
| 3,168,313 | A | 2/1965 | Lint |
| 3,738,657 | A | 6/1973 | Cox |
| 4,166,619 | A | 9/1979 | Bergmann et al. |
| 4,973,060 | A | 11/1990 | Herzing |
| 5,066,021 | A | 11/1991 | DeLucia |
| 5,372,588 | A | 12/1994 | Farley et al. |
| 5,820,498 | A | 10/1998 | Maleski |
| 5,941,784 | A | 8/1999 | Mizek |
| 6,200,237 | B1 | 3/2001 | Barrie |
| 6,217,467 | B1 | 4/2001 | Maleski |
| 6,258,000 | B1 | 7/2001 | Liechty, II |
| 6,270,435 | B1 | 8/2001 | Sodaro |
| 6,283,880 | B1 | 9/2001 | Barrie |

(Continued)

FOREIGN PATENT DOCUMENTS

| | | |
|---|---|---|
| CN | 207456305 U | 6/2018 |
| CN | 109780944 A | 5/2019 |

*Primary Examiner* — John A Ricci
(74) *Attorney, Agent, or Firm* — Banner & Witcoff, Ltd.

(57) ABSTRACT

A variable cutting diameter arrowhead includes a first blade, a second blade, and a ferrule, where the first blade and the second blade have a stowed position and a deployed position. The first blade and the second blade may be pivotally attached to the ferrule. In addition, a resilient member may be within a ferrule cavity, where the resilient member applies a force to a blade locking member that engages the first blade and the second blade to retain the blades in a stowed position. When the blades are in a deployed position, the distance between a distal end of the first blade and an outer surface of the ferrule is greater than the distance between the distal end of the first blade and the outer surface of the ferrule is in the stowed position.

14 Claims, 20 Drawing Sheets

(56) References Cited

U.S. PATENT DOCUMENTS 6,287,224 B1 9/2001 Liechty, II
6,322,464 B1 11/2001 Sestak
6,398,676 B1 6/2002 Mizek
6,554,727 B1 4/2003 Armstrong et al.
6,663,518 B1 12/2003 Kuhn
6,669,586 B2 12/2003 Barrie et al.
6,789,346 B1 9/2004 Holler
6,793,596 B1 9/2004 Sullivan et al.
6,935,976 B1 8/2005 Grace, Jr. et al.
7,011,589 B2 3/2006 Davis
7,025,697 B2 4/2006 Mizek et al.
7,226,375 B1 6/2007 Sanford
7,234,220 B1 6/2007 Grace, Jr.
7,311,621 B2 12/2007 Sullivan et al.
7,314,419 B2 1/2008 Grace et al.
RE40,273 E 4/2008 Grace, Jr. et al.
7,377,869 B2 5/2008 Wohlfeil et al.
7,422,533 B1 9/2008 Johnson
D583,897 S 12/2008 Ward
7,571,564 B2 8/2009 Sullivan
7,682,271 B2 3/2010 Rager
7,713,151 B2 5/2010 Fulton
7,713,152 B1 5/2010 Tentler et al.
7,771,298 B2 8/2010 Pulkrabek
7,905,802 B2 * 3/2011 Erhard ..... F42B 6/08 473/583
7,942,765 B2 5/2011 Odabachian et al.
8,029,392 B2 10/2011 Bolen, III
8,043,177 B2 10/2011 Flanagan
8,052,554 B2 11/2011 Lee
8,062,155 B2 11/2011 Butcher
8,113,973 B1 2/2012 Lee
8,128,521 B1 3/2012 Ulmer
8,147,360 B2 4/2012 Simo et al.
8,147,361 B1 4/2012 Weaver
8,182,378 B1 5/2012 Futtere
8,197,367 B2 6/2012 Pulkrabek et al.
D664,230 S 7/2012 Musacchia, Jr.
8,210,971 B1 7/2012 Fulton
8,210,972 B2 7/2012 Adams et al.
8,272,979 B1 9/2012 Cooper
8,328,667 B2 12/2012 Adams et al.
RE44,144 E 4/2013 Barrie et al.
8,414,432 B1 4/2013 Hand
8,449,415 B2 5/2013 Grace
8,449,416 B2 5/2013 Grace et al.
8,496,550 B2 7/2013 Zeren
RE44,474 E 9/2013 Vandewater
8,545,349 B1 10/2013 Budris et al.
8,545,350 B2 10/2013 Goodwin et al.
8,663,041 B1 3/2014 Gryspeerd
8,684,869 B1 4/2014 Perry
D704,787 S 5/2014 Gryspeerd
8,734,276 B2 5/2014 Laurienzo et al.
8,758,176 B2 6/2014 Pedersen
D710,962 S 8/2014 Pedersen
D711,489 S 8/2014 Pedersen
8,894,519 B2 11/2014 Young
8,911,310 B2 12/2014 Lee
8,911,311 B1 12/2014 Mizek et al.
8,915,808 B2 12/2014 Powell
8,926,457 B2 1/2015 Treto
8,986,141 B2 3/2015 Pedersen
D730,471 S 5/2015 Pedersen
9,046,331 B1 6/2015 Mallo
9,068,806 B2 6/2015 Pedersen
9,091,515 B1 7/2015 Lee
9,109,863 B2 8/2015 York
9,115,962 B1 8/2015 Weaver
9,121,676 B1 9/2015 Coalson et al.
9,170,078 B2 10/2015 Pedersen
9,194,673 B1 11/2015 Lee
9,228,813 B1 1/2016 Pedersen
9,267,773 B2 2/2016 Mizek
D751,163 S 3/2016 Ohlau
9,303,962 B1 4/2016 Burnworth et al.
9,303,963 B1 4/2016 Ford
9,329,005 B2 5/2016 Meier et al.
9,329,006 B1 5/2016 Hansen
9,341,449 B2 5/2016 Pedersen
9,341,450 B1 5/2016 Lin
9,341,451 B1 5/2016 Campbell et al.
9,347,751 B2 5/2016 Hollars
9,372,056 B2 6/2016 Sullivan et al.
9,400,160 B1 7/2016 Miles
D765,208 S 8/2016 Loa
9,404,722 B2 8/2016 Pedersen
9,410,778 B2 8/2016 Pedersen
D774,615 S 12/2016 Pedersen
9,526,234 B2 12/2016 Harshberger
D776,782 S 1/2017 Pedersen
9,683,813 B2 6/2017 Beckman
9,723,820 B2 8/2017 Harshberger
9,750,995 B2 9/2017 Nally
9,772,170 B1 9/2017 Lathrop
9,803,962 B2 10/2017 Hahn
9,803,963 B1 10/2017 Huang
9,857,152 B2 1/2018 Franco, Sr.
9,857,153 B1 1/2018 Redline
9,879,955 B2 1/2018 Rowley
9,903,693 B2 2/2018 Salvino et al.
9,945,647 B2 4/2018 Pugliese et al.
9,945,648 B2 4/2018 Grace
9,982,974 B1 5/2018 McGaha
10,012,487 B2 7/2018 Isaacson
10,030,949 B1 7/2018 Grace
10,034,464 B2 7/2018 Sullivan
10,041,772 B1 8/2018 Sullivan
10,066,912 B2 9/2018 Grace
10,077,975 B2 9/2018 Haas
10,082,373 B2 9/2018 Romero
10,168,130 B1 1/2019 Wang
10,180,312 B2 1/2019 Asbill
D847,290 S 4/2019 Betty
D847,937 S 5/2019 Isringhausen
D849,873 S 5/2019 Betty
10,281,250 B2 5/2019 Beck et al.
10,288,392 B2 5/2019 Haas
10,295,316 B2 5/2019 Wukie
10,295,321 B2 5/2019 Braden et al.
10,337,843 B1 7/2019 Kinzer
10,352,665 B2 7/2019 Haas
10,352,666 B2 7/2019 Haas
10,352,667 B2 7/2019 Salvino
10,393,485 B1 8/2019 Painter et al.
10,415,940 B2 9/2019 Sullivan et al.
D865,102 S 10/2019 Haas
10,436,556 B1 10/2019 Ohlau
10,458,763 B2 10/2019 Blosser et al.
10,458,767 B2 10/2019 Buchanan
D870,231 S 12/2019 Haas
10,514,238 B2 12/2019 Razmus, II et al.
10,591,262 B1 3/2020 Osborn et al.
10,598,469 B2 3/2020 Lankford
10,598,470 B1 3/2020 Sanford
10,627,197 B2 4/2020 Kozlik et al.
10,746,514 B1 8/2020 Stacy
10,809,044 B2 10/2020 Perry
10,823,537 B2 11/2020 Jones
10,837,742 B2 11/2020 Romero
10,837,743 B1 11/2020 Beam et al.
10,921,102 B1 2/2021 Albanese
11,002,522 B1 5/2021 Tagget et al.
11,033,011 B2 6/2021 Isringhausen
D924,351 S 7/2021 Derus et al.
11,054,228 B2 7/2021 Romero
11,085,743 B2 8/2021 Buchanan
11,105,594 B2 8/2021 Decker
11,125,542 B2 9/2021 Motz
11,137,235 B2 10/2021 Fischer
11,137,236 B2 10/2021 Randall et al.
11,619,472 B1 4/2023 Major
2001/0036876 A1 11/2001 Barrie et al.
2006/0084535 A1 4/2006 Kuhn

(56) References Cited

U.S. PATENT DOCUMENTS

| | | | |
|---|---|---|---|
| 2007/0161438 | A1 | 7/2007 | Fulton |
| 2008/0102996 | A1 | 5/2008 | Erhard |
| 2015/0184986 | A1 | 7/2015 | Franco, Sr. |
| 2016/0174535 | A1 | 6/2016 | Harshberger |
| 2017/0131073 | A1 | 5/2017 | Buchanan |
| 2019/0154417 | A1 | 5/2019 | Beam et al. |
| 2020/0132423 | A1 | 4/2020 | Razmus, II et al. |

* cited by examiner

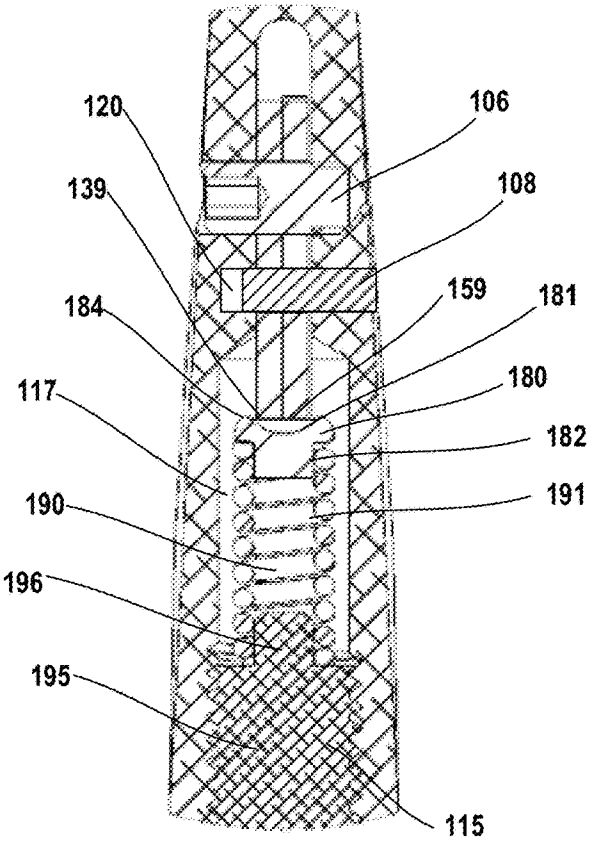
FIG. 9
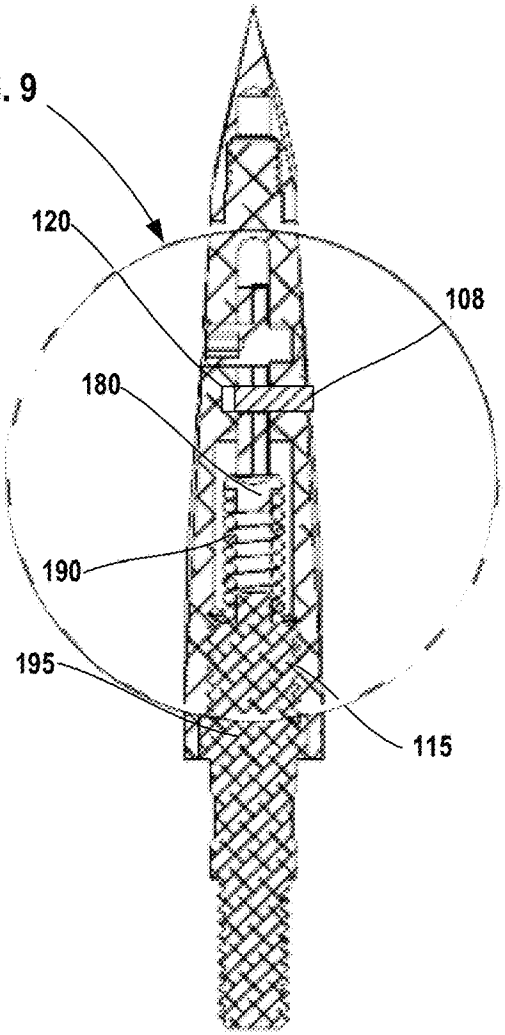
FIG. 9
FIG.8
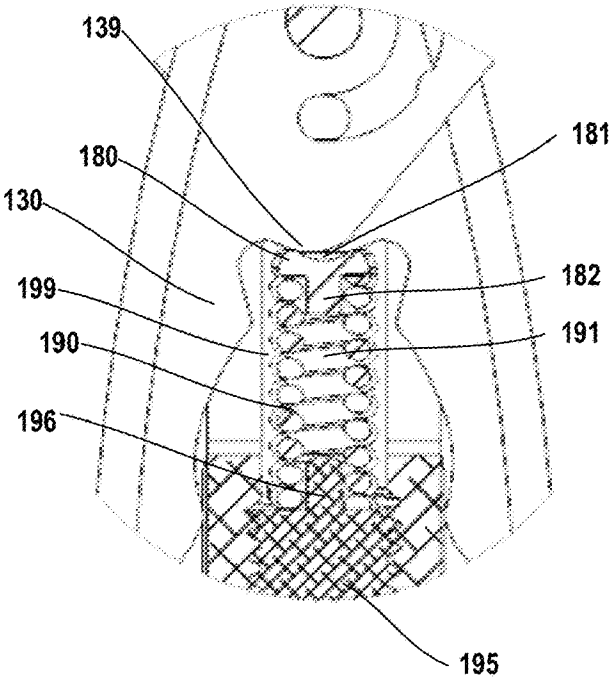
FIG. 7

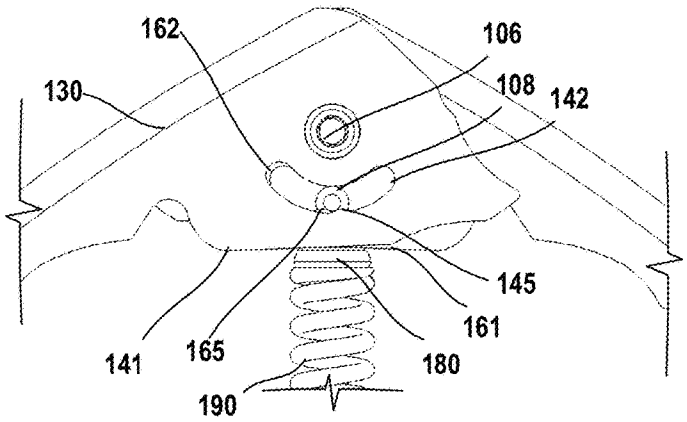
FIG. 10B
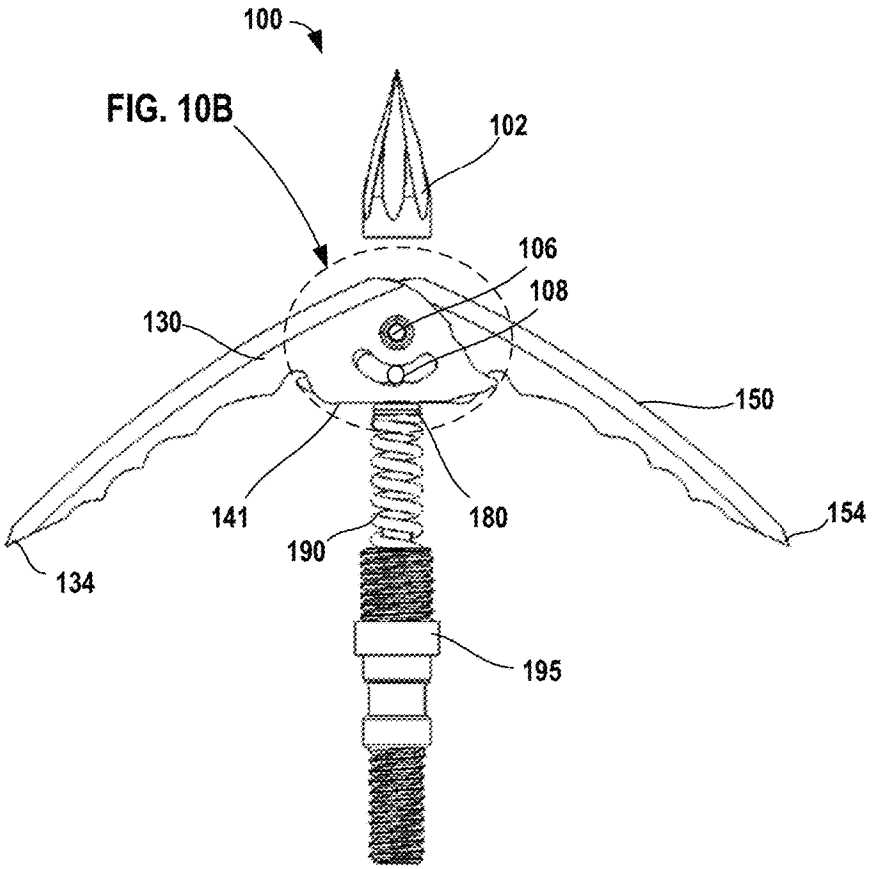
FIG. 10B
FIG. 10A

VARIABLE CUTTING DIAMETER ARROWHEAD

CROSS-REFERENCE TO RELATED MATTERS

This application claims priority to and the benefit of U.S. Provisional Patent Application No. 63/531,968 filed on Aug. 10, 2023, which is incorporated by reference herein in its entirety.

TECHNICAL FIELD

The present disclosure generally relates to arrowheads for archery, in particular, arrowheads that have an adjustable cutting diameter.

BACKGROUND

Arrowheads typically used for hunting medium or large game animals may include a large cutting diameter to create large wounds in the animal to quickly and ethically kill the animal. The arrowheads may have fixed blades, which are not movable, or a mechanical broadhead arrowhead. A mechanical broadhead arrowhead may include blades that can have a stowed position and a deployed position to provide a larger cutting diameter than when the arrowhead is in the stowed position.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of this disclosure may relate to an arrowhead, comprising: (a) a ferrule that includes a first end, a second end, and a ferrule body extending between the first end and the second end that defines a longitudinal axis, the ferrule body further including a blade pivot hole that defines a blade pivot axis and a ferrule cavity, where the blade pivot axis is generally perpendicular to the longitudinal axis; (b) a resilient member and a blade locking member located within the ferrule cavity, where the blade locking member is connected to an upper portion the resilient member; (c) a first blade having a first cutting portion, where the first blade is pivotally attached to the ferrule at the blade pivot axis, where the first blade includes a first blade pivot aperture, a first blade locking geometry, and a first rear surface opposite the first cutting portion; and (d) a second blade having a second cutting portion, wherein the second blade is pivotally attached to the ferrule at the blade pivot axis, where the second blade includes a second blade pivot aperture, and a second rear surface opposite the second cutting portion. The first blade locking geometry may include a convex curved surface. The first blade and the second blade may be pivotally attached to the ferrule along a blade pivot pin that extends through the first blade pivot aperture, the second blade pivot aperture, and the blade pivot hole. The first blade and the second blade may have a stowed position and a deployed position, where the stowed position is defined by a portion of the first rear surface contacting an outer surface of the ferrule. The blade locking member may comprise a concave surface that contacts the first blade locking geometry when the arrowhead is in the stowed position, where the deployed position is defined by the first rear surface being free of contact with the outer surface of the ferrule. The first rear surface of the first blade may include a first plurality of protuberances that contact the outer surface of the ferrule when the first blade is in the stowed position. In addition, the second rear surface of the second blade may include a second plurality of protuberances that contact the outer surface of the ferrule when the second blade is in the stowed position. The second blade may include a second blade locking geometry, where the second blade locking geometry includes a convex curved surface, and the concave surface of the blade locking member contacts the second blade locking geometry when the arrowhead is in the stowed position. The first blade may include a first deployment tab, and when the first deployment tab receives a predetermined force, the first deployment tab rotates causing the first blade locking geometry to be free of contact with the blade locking member and both the first blade and the second blade to move to the deployed position. The resilient member may be a compression spring. The resilient member may comprise a first resilient member and a second resilient member, where the second resilient member has a nested configuration with the first resilient member such that the first resilient member surrounds a portion of the second resilient member. The first resilient member may be a first compression spring, and the second resilient member may be a second compression spring. The first compression spring may have a first free length and the second compression spring has a second free length, where the first free length is greater than the second free length. The resilient member may have a first end and a second end opposite the first end, where the first end has a first diameter and the second end has a second diameter. The first diameter may be greater than the second diameter. The resilient member may have an outer profile that extends between the first end and the second end, where the outer profile of the resilient member tapers linearly from the first end to the second end. The second diameter may be within a range of 70 percent and 85 percent of the first diameter. The resilient member may have a maximum diameter within a range of 70 percent and 95 percent of the diameter of the ferrule cavity, where the diameter of the ferrule cavity is measured at a location at an approximate center of a longitudinal length of the resilient member. The blade pivot axis may be positioned along the longitudinal axis of the ferrule.

Other aspects of this disclosure may relate to an arrowhead, comprising: (a) a ferrule that includes a first end, a second end, and a ferrule body extending between the first end and the second end that defines a longitudinal axis, and a ferrule cavity located within the ferrule body; (b) a first blade having a first cutting portion; where the first blade is pivotally attached to the ferrule at a blade pivot axis; and (c) a resilient member received within the ferrule cavity, where the resilient member has a first end and a second end opposite the first end, where the first end has a first diameter and the second end has a second diameter, and the first diameter is greater than the second diameter. The first blade may have a stowed position and a deployed position; where the resilient member provides a force to deploy the first blade from the stowed position to the deployed position. A first distance between a distal end of the first blade and an outer surface of the ferrule is greater than a second distance between the distal end of the first blade and the outer surface of the ferrule when the first blade is in the deployed position than in the stowed position. The resilient member may have an outer profile that extends between the first end and the second end, where the outer profile of the resilient member tapers linearly from the first end to the second end. The second diameter is within a range of 70 percent and 85 percent of the first diameter.

Additional aspects of this disclosure may relate to an arrowhead comprising: (a) a ferrule that includes a first end, a second end, a ferrule body extending between the first end and the second end that defines a longitudinal axis, and a ferrule cavity; (b) a first blade having a first cutting portion, where the first blade is pivotally attached to the ferrule at a blade pivot axis; and (c) a first resilient member and a second resilient member located within the ferrule cavity, where the second resilient member has a nested configuration with the first resilient member such that the first resilient member surrounds a portion of the second resilient member. The first blade may have a stowed position and a deployed position. The first resilient member and the second resilient member provide a force to deploy the first blade from the stowed position to the deployed position. A first distance between a distal end of the first blade and an outer surface of the ferrule is greater than a second distance between the distal end of the first blade and the outer surface of the ferrule when the first blade is in the deployed position than in the stowed position. The first resilient member may be a first compression spring, and the second resilient member is a second compression spring. The first compression spring may have a first free length and the second compression spring has a second free length, where the first free length is greater than the second free length. A second blade may have a second cutting portion, where the second blade is pivotally attached to the ferrule at the blade pivot axis. The force from the first and the second resilient members also moves the second blade from the stowed position to the deployed position, and where a second distance between a distal end of the second blade and the outer surface of the ferrule is greater in the deployed position than in the stowed position. The first blade may include a first blade locking geometry, where the first blade locking geometry includes a first convex curved surface. A blade locking member may comprise a concave surface that contacts the first blade locking geometry when the arrowhead is in the stowed position.

BRIEF DESCRIPTION OF DRAWINGS

The present disclosure is illustrated by way of example and not limited in the accompanying figures in which like reference numerals indicate similar elements and in which:

FIG. 7 depicts an enlarged view of the cross-sectional view of FIG. 6, according to aspects described herein.

FIG. 8 depicts a cross-sectional view of the exemplary arrowhead of FIG. 1 with the blades in a stowed position along line 8-8, according to aspects described herein.

FIG. 9 depicts an enlarged view of the cross-sectional view of FIG. 8, according to aspects described herein.

FIG. 10A depicts a front view of the exemplary arrowhead of FIG. 1 with the blades in a deployed position with some components removed for clarity, according to aspects described herein.

FIG. 10B depicts an enlarged view of the cross-sectional view of FIG. 10B, according to aspects described herein

DETAILED DESCRIPTION

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure. Also, while the terms "upper," "lower," "front," "side," "above", "below", and the like may be used in this specification to describe various example features and elements of the examples, these terms are used herein as a matter of convenience, e.g., based on the example orientations shown in the figures or the orientation during typical use. Nothing in this specification should be construed as requiring a specific three-dimensional orientation of structures in order to fall within the scope of this disclosure.

The term "plurality," as used herein, indicates any number greater than one, either disjunctively or conjunctively, as necessary, up to an infinite number.

The term "connect," as used herein indicates that components, surfaces, or features and the like may be directly or indirectly (e.g., through an intermediary) joined, linked or attached.

As used herein, the term "generally" means mostly, or almost the same as, within the constraints of sensible commercial engineering objectives, costs, manufacturing tolerances, and capabilities in the field of manufacturing the article being formed.

This disclosure may discuss an arrowhead with deployable blades such that the blades may have a stowed position to allow the arrowhead to have a streamlined and aerodynamic shape when in flight and have blades that deploy to create an expanded cutting diameter when the arrowhead impacts the target to improve the efficiency of the arrowhead. Various examples are discussed which provide the arrowhead with a consistent and rapid deployment of both blades. Once deployed, the blades are able to deflect independently if they contact a hardened region of a target, such as a bone, and then once the blade or blades move past the hardened region they expand outward again to maximize the cutting diameter. As discussed in more detail below, a resilient member, which may be a compression spring or plurality of compression springs, provides a force on the blades to maximize the cutting diameter of the arrowhead. In addition, each exemplary arrowhead is provided with a means to deploy the blades when the arrowhead contacts a target. The deployment means may be interaction between geometry on the blades and a blade locking member, a trigger mechanism, or other means described herein.

Figure 2:
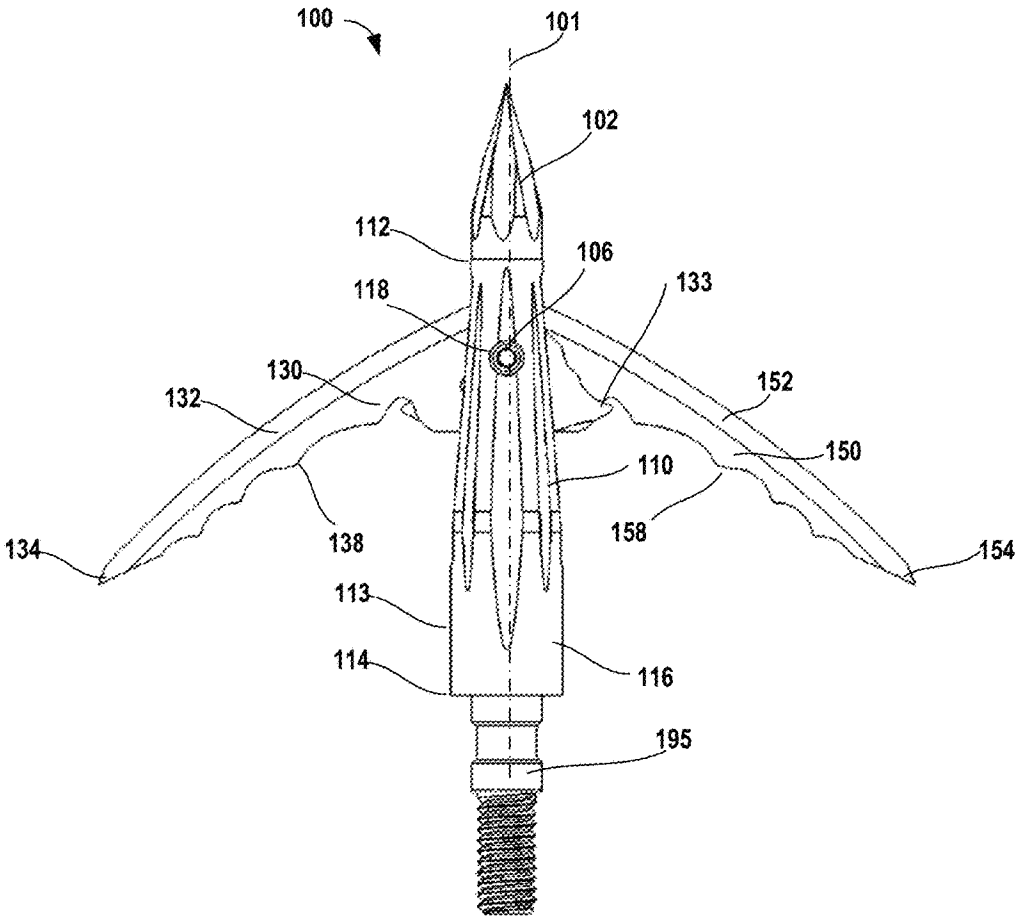
FIG. 2 depicts a front view of the exemplary arrowhead of FIG. 1 with the blades in a deployed position, according to aspects described herein.
Figure 1:
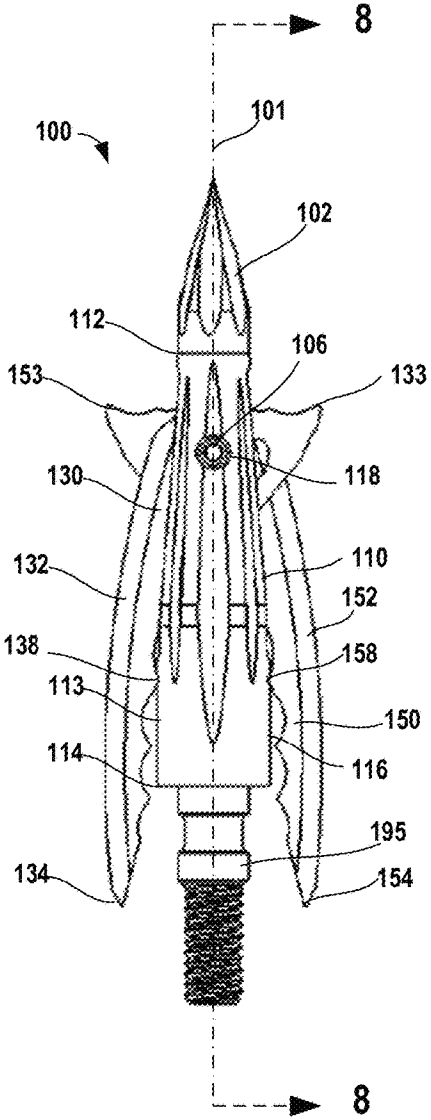
FIG. 1 depicts a front view of an exemplary arrowhead with the blades in a stowed position, according to aspects described herein.
Figure 3:
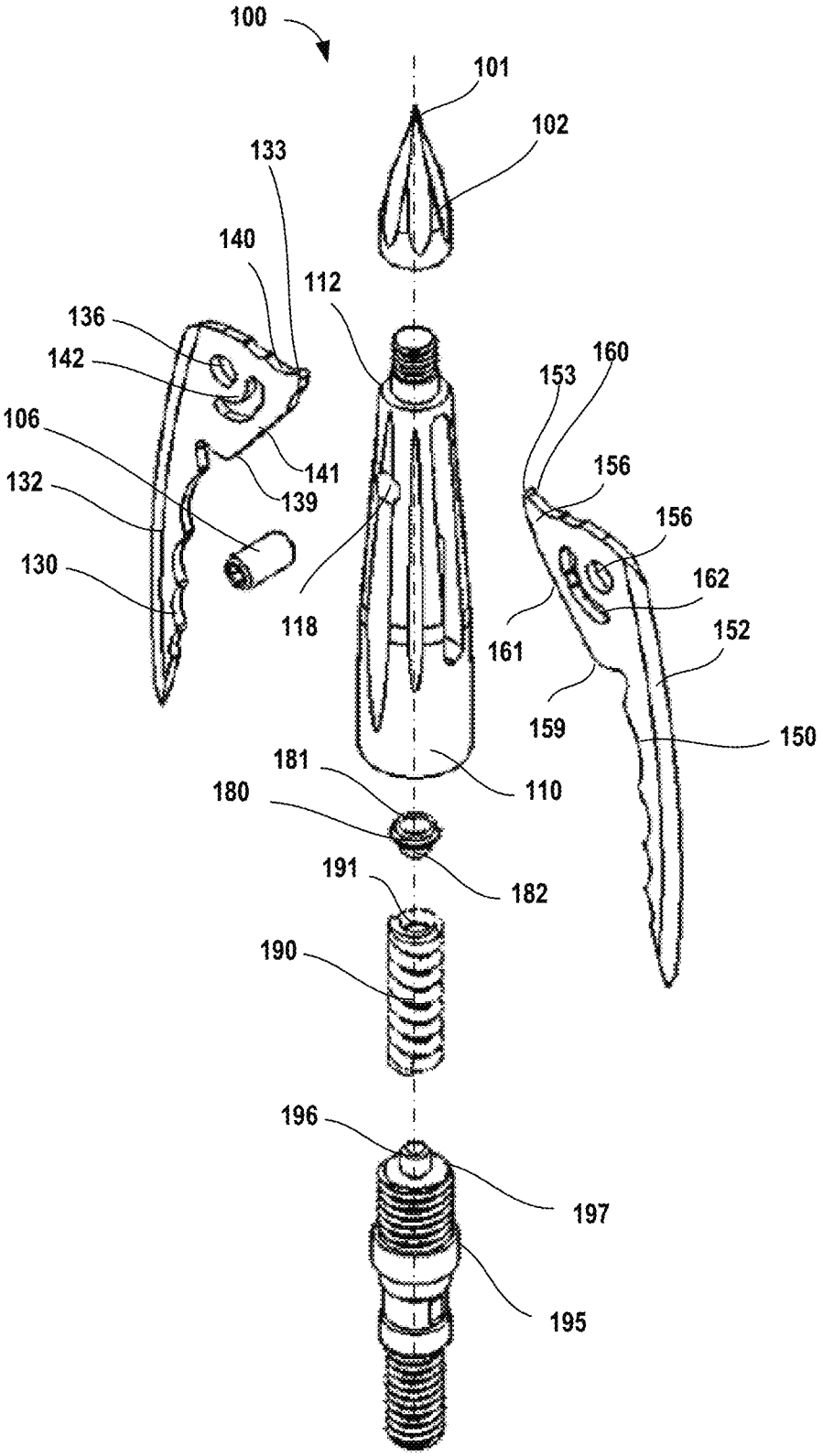
FIG. 3 depicts a front perspective exploded view of the exemplary arrowhead of FIG. 1 with the blades in a stowed position, according to aspects described herein.
Figure 6:
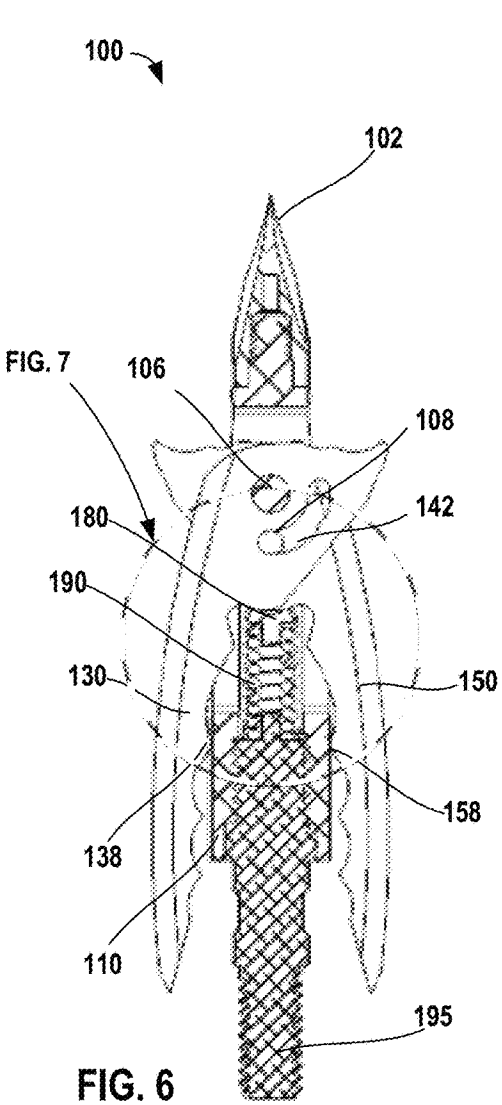
FIG. 6 depicts a cross-sectional view of the exemplary arrowhead of FIG. 1 with the blades in a stowed position along line 6-6, according to aspects described herein.
Figure 5:
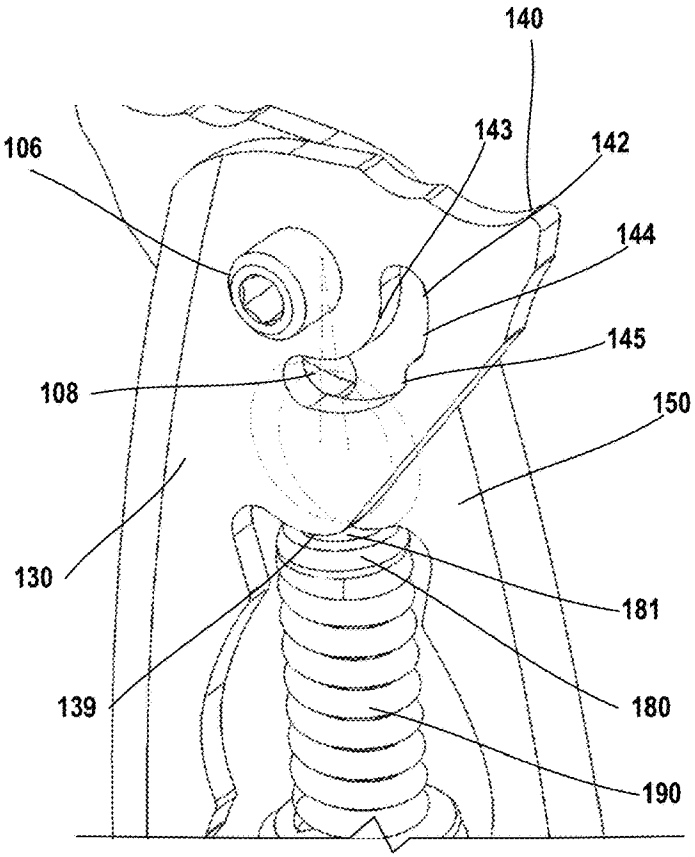
FIG. 5 depicts a partial front perspective view of the exemplary arrowhead of FIG. 1 with the blades in a stowed position with some components removed for clarity, according to aspects described herein.
Figure 4:
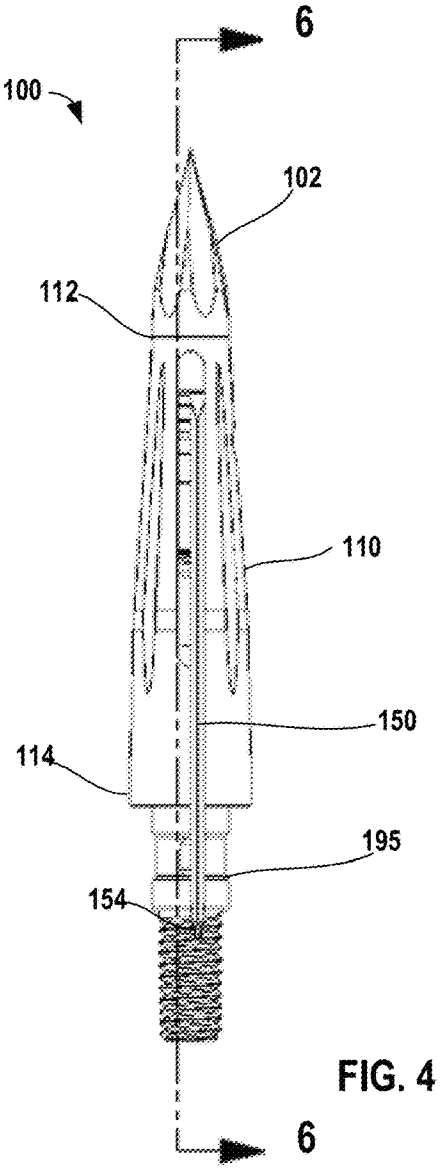
FIG. 4 depicts a side view of the exemplary arrowhead of FIG. 1 with the blades in a stowed position, according to aspects described herein.

Aspects of this disclosure may relate to an arrowhead 100 with blades 130, 150 that can be moved from a stowed position to a deployed position as shown in FIGS. 1-13. The blades 130, 150 may be pivotally attached to the ferrule 110 along a blade pivot pin 106. The arrowhead 100 may be configured such that the blades 130, 150 deploy from a stowed position to a deployed position almost simultaneously to ensure a uniform cut and improve performance of the arrowhead 100. The arrowhead 100 may include a longitudinal axis 101 along a centerline of the arrowhead 100. FIGS. 1 and 3 illustrate arrowhead 100 with the blades 130, 150 in a stowed position where a portion of the blades 130, 150 may contact an outer surface 113 of the ferrule 110, such as a portion of the surface opposite the cutting portion 132, 152 of the blades 130, 150 being in contact with the outer surface 113 of the ferrule 110. FIG. 2 illustrates the blades 130, 150 in a deployed position, where the distal ends 134, 154 of the blades 130, 150 are extended away from the outer surface of the ferrule 110 at a distance that is greater than when the blades 130, 150 are in the stowed position. In some examples, the deployed position may be defined by a portion of the surface opposite the cutting portion 132, 152 of the blades 130, 150 being free of contact with the outer surface of the ferrule 110. For example, in the illustrated example, the deployed position may be defined a position when all of the protuberances 138, 158 of the blades 130, 150 are free of contact with the outer surface 113 of the ferrule 110. The deployed blades 130, 150 may extend to reach a maximum cutting diameter, D, where the maximum cutting diameter is measured as a horizontal distance between the distal ends 134, 154 of the blades 130, 150. In the illustrated example, the arrowhead 100 may include a resilient member 190, such as a compression spring, that allows the blades 130, 150 to fluctuate or change in cutting diameter while penetrating a target, such that each blade 130, 150 may deflect inward independently when contacting a hardened region of a target, such as a bone. This inward deflection of one or more of the blades 130, 150 allows the arrowhead 100 to penetrate further into the target because the inward deflected blade 130, 150 is not encumbered by the blade contacting a hardened region, like a bone, of the target allowing the arrowhead to move beyond the hardened region and in some cases can prevent the hardened region from potentially dulling or damaging the cutting portion 132, 152 of the blades 130, 150.

The ferrule 110 may comprise a first end 112, a second end 114, and a ferrule body 116 that extends between the first end 112 and the second end 114. The point 102 may be a separate component fixedly or removably connected to the first end 112. Alternatively, the ferrule 110 may be integrally formed with a point 102 at the first end 112. The ferrule body 116 may also include a blade pivot hole 118 that defines a blade pivot axis, a guide pin hole 120. The blade pivot hole 118 and blade pivot axis may be centered along the longitudinal axis 101 of the arrowhead 100. In some examples, the guide pin hole 120 may also be centered along the longitudinal axis 101. In other examples, the blade pivot hole 118 and the guide pin hole 120 may be offset from the longitudinal axis 101. Optionally, the arrowhead 100 may have a pair of blade pivot holes 118 arranged on each side of the longitudinal axis 101. Additionally, the blade pivot hole 118 and blade pivot axis may be generally perpendicular to the longitudinal axis 101.

Blade 130 may have a cutting portion 132, which may be located on an exterior edge of the blade 130 with a distal end 134. In addition, blade 130 may include a blade pivot aperture 136 that receives a blade pivot pin 106 that also extends into the blade pivot hole 118. A plurality of protuberances 138 may be arranged on an opposite side from the cutting portion 132. The blade 130 may also include a locking geometry 139 that interacts with a blade locking member 180 when the arrowhead 100 is in a stowed position. The locking geometry 139 may comprise a convex curved surface. In addition, blade 130 may include a deployment tab 140 at a first end 133 opposite the distal end 134 to assist in the deployment of the blade 130 and a deployment geometry 141 that that interacts with a blade locking member 180 when the arrowhead 100 is in a deployed position. The blade 130 may also have a guide slot 142 that receives a guide pin 108 that is also received in the guide pin hole 120 of the ferrule 110. The guide slot 142 may be located below (i.e. closer to the second end 114 of the ferrule 110) and spaced from the blade pivot aperture 136. The guide slot 142 may have a curved shape, where curved shape or arcuate shape that may be centered on the blade pivot aperture 136. The guide slot 142 may comprise an inboard edge 143, an outboard surface 144, and a raised stop surface 145 along the outboard surface 144. In some examples, the blades 130, 150 may not have a guide slot or a guide pin 108, such that the interaction of the resilient member 190 and/or the blade locking member 180 with the deployment geometry 141, 161 of the blades 130, 150 controls the width of the cutting diameter of the blades 130, 150 when in a deployed position.

Similarly, blade 150 may have a cutting portion 152, which may be located on an exterior edge of the blade 150 with a distal end 154. In addition, blade 150 may include a blade pivot aperture 156 that receives a blade pivot pin 106 that also extends into the blade pivot hole 118. A plurality of protuberances 158 may be arranged on an opposite side from the cutting portion 152. The blade 150 may also include a locking geometry 159 that interacts with a blade locking member 180 when the arrowhead 100 is in a stowed position. The locking geometry 159 may comprise a convex curved surface. In addition, blade 150 may include a deployment tab 160 at a first end 153 opposite the distal end 154 to assist in the deployment of the blade 150 and a deployment geometry 161 that that interacts with a blade locking member 180 when the arrowhead 100 is in a deployed position. The blade 150 may also have a guide slot 162 that receives a guide pin 108 that is also received in the guide pin hole 120 of the ferrule 110. The guide slot 162 may be located below (i.e. closer to the second end 114 of the ferrule 110) and spaced from the blade pivot aperture 156. The guide slot 162 may have a curved shape, where curved shape of may be centered on the blade pivot aperture 156. The guide slot 162 may be similar in shape and size to guide slot 142 and comprise an inboard surface 143, an outboard surface 144, and a raised stop surface 145 along the outboard surface 144.

As shown in FIG. 1, a protuberance 138, 158 of each blade 130, 150 may contact an outer surface of the ferrule 110. By having a surface on an opposite side of the cutting portion 132, 152 of the blade, such as a protuberance 138, 158, contact the outer surface of the ferrule 110, the blades 130, 150 are constrained in one direction such that when the blades 130, 150 are in a stowed position, the blades 130, 150 may only move outward away from the ferrule 110 and prevent any inadvertent deformation of the resilient member 190 to control the direction of force the resilient member 190 will impart onto the blade 130, 150 whose deployment tab 140, 160 was not contacted at impact that caused the deployment of the blades 130, 150. While the exemplary blades 130, 150 illustrate protuberances 138, 158 respectively, it is contemplated that the surface opposite the cutting portions 130, 150 may free of protuberances and be a planar surface opposite the cutting portion 132, 152 or a curved opposite surface opposite the cutting portion 132, 152.

The blade lock geometry 139, 159 may not be concentric with the concave surface 181 in an upper surface 184 of the blade locking member 180. The contact point between the protuberance 138, 158 and the ferrule 110 prevents the blade locking member 180 from moving as the forces between the blades 130, 150, the blade locking member 180, and the resilient member 190 are in equilibrium. The concave surface 181 of the blade locking member 180 may have a radius within a range of 0.05 inches and 0.15 inches, or within a range of 0.15 inches and 0.25 inches such that the contact points of the locking geometries 139, 159 contact the concave surface 181 away from a lowest point of the concave surface 181 to help balance the forces between the blades 130, 150, the blade locking member 180, and the resilient member 190. The outer upper surface 184 of the blade locking member 180 may include a convex surface that is adjacent the concave surface 181. In addition, the perimeter (i.e., diameter of a round shape) of the outermost portion of upper surface 184 may be equal to or larger than a diameter of an upper portion of the resilient member 190. By having the perimeter of the outermost portion of the upper surface 184 equal to or larger than the upper portion of the resilient member 190, the blade locking member 180 limits off-axis deformation of the resilient member 190 to better control the deployment of the blades 130, 150 as well as any blade deformation due to contacting a bone or hard element when penetrating a target. In some examples, the diameter of the outermost portion of the upper surface 184 may be smaller than a diameter of the upper portion of the resilient member 190.

As shown in FIGS. 6-9, the resilient member 190 may be located within the ferrule cavity 119, where the resilient member 190 is positioned between the stem 195 that releasably engages the ferrule 110 and the blade locking member 180. The stem 195 may have a central protrusion 196 positioned at an upper surface 197 of the stem 195. The central protrusion 196 may be received within an opening 191 at a lower portion of the resilient member 190. The central protrusion 196 may help to fix the lower portion of the resilient member 190 within the ferrule cavity 119. By fixing the lower portion of the resilient member 190, the upper portion may be free to move. It is contemplated that a lower end of the resilient member 190 may be fixed to prevent any vertical or horizontal movement within the ferrule cavity (i.e. the lower end is fixed to ensure that it is generally concentric with the ferrule 110 and the ferrule cavity 119). The lower end of the resilient member 190 may be fixed using an adhesive or other means known to one skilled in the art. In addition, the blade locking member 180 may have a concave surface 181 located in an upper portion of the blade locking member 180 that engages the locking geometry 139, 159 of the blades 130, 150. The blade locking member 180 may be connected to the resilient member 190. For example, the blade locking member 180 may also include a central protrusion 182 that extends downward from a lower surface 183, where the central protrusion 182 of the blade locking member 180 is received within an upper portion of the opening 191 of the resilient member 190. The locking geometry 139, 159 of the blades 130, 150 may include a convex surface that engages the concave surface 181 of the blade locking member 180. The blades 130, 150 may be pivotally engaged by a blade pivot pin 106 that extends into a blade pivot hole 118 in the ferrule 110 and extends through the blade pivot apertures 136, 156 of each blade 130, 150. In addition, a guide pin 108 may extend through the guide pin hole 120 and also extend through the guide slots 142, 162 of each respective blade 130, 150. Alternatively, the locking geometry 139, 159 of the blades 130, 150 may include a concave surface that engages a convex surface of the blade locking member 180. In some examples, the arrowhead 100 may not have a blade locking member 180 such that the locking geometry 139, 159 and the deployment geometry 141, 161 of the blades 130, 150 interact directly with an upper portion of the resilient member 190.

To deploy the blades 130, 150 from a stowed position, one of the deployment tabs 140, 160, which extend outward from ferrule 110, may contact a target. Each deployment tab 140, 160 is positioned on an opposite side of a corresponding cutting portion 132, 152 of each blade 130, 150. The blade pivot pin 106 may be positioned between the deployment tabs 140, 160 and the cutting portions 132, 152 of each blade. In this manner, an impact of the deployment tab 140 with a target causes a rotational movement of the deployment tab 140 toward an outer surface of the ferrule 110, which also causes an outward movement of the distal end 134 of the blade 130 away from the ferrule 110. Similarly, an impact of the deployment tab 140 with a target causes a rotational movement of the deployment tab 140 toward an outer surface of the ferrule 110, which also causes an outward movement of the distal end 134 of the blade 130 away from the ferrule 110.

The interaction of the concave surface 181 and the blade locking geometry 139, 159 causes the blades 130, 150 to stay in a stowed position until one of the deployment tabs 140, 160 receives a force from an impact that is greater than a predetermined release force. Once the predetermined release force is received, the blades 130, 150 may move to a deployed position. The predetermined release force may be a result of multiple factors such as the spring constant of the resilient member 190, the distance the resilient member 190 is compressed, the diameter and concavity geometry of the blade locking member 180, and the locking geometry 139, 159 of the blades 130, 150. In addition, the surface finish of the blade locking member 180 may affect the predetermined release force. Optionally, a lubricant, such as lithium grease or similar, may be added to the blade locking member 180 to help minimize any friction between the contact regions of the blade locking member 180 and the blade locking geometry 139, 159 of the blades 130, 150.

The arrowhead 100 is arranged such that if either deployment tab 140, 160 receives a force from an impact that is greater than a predetermined release force, both blades 130, 150 will deploy. The locking geometry 139, 159 of the blade 130, 150 whose deployment tab 140, 160 received the force will move away from the blade locking member 180 allowing distal end 134, 154 of the corresponding blade 130, 150 to rotate outward (i.e. away from the ferrule 110). The blade locking geometry 139, 159, the blade locking member 180, and the resilient member 190 are in an equilibrium when the arrowhead is in the stowed position such that if one of the blades 130, 150 receives a release force, the blade not receiving the force will be released as well as a single one of the blades 130, 150 cannot stay in the stowed position by itself. Thus, both blades 130, 150 will deploy almost simultaneously.

Figures 11, 12, 13:
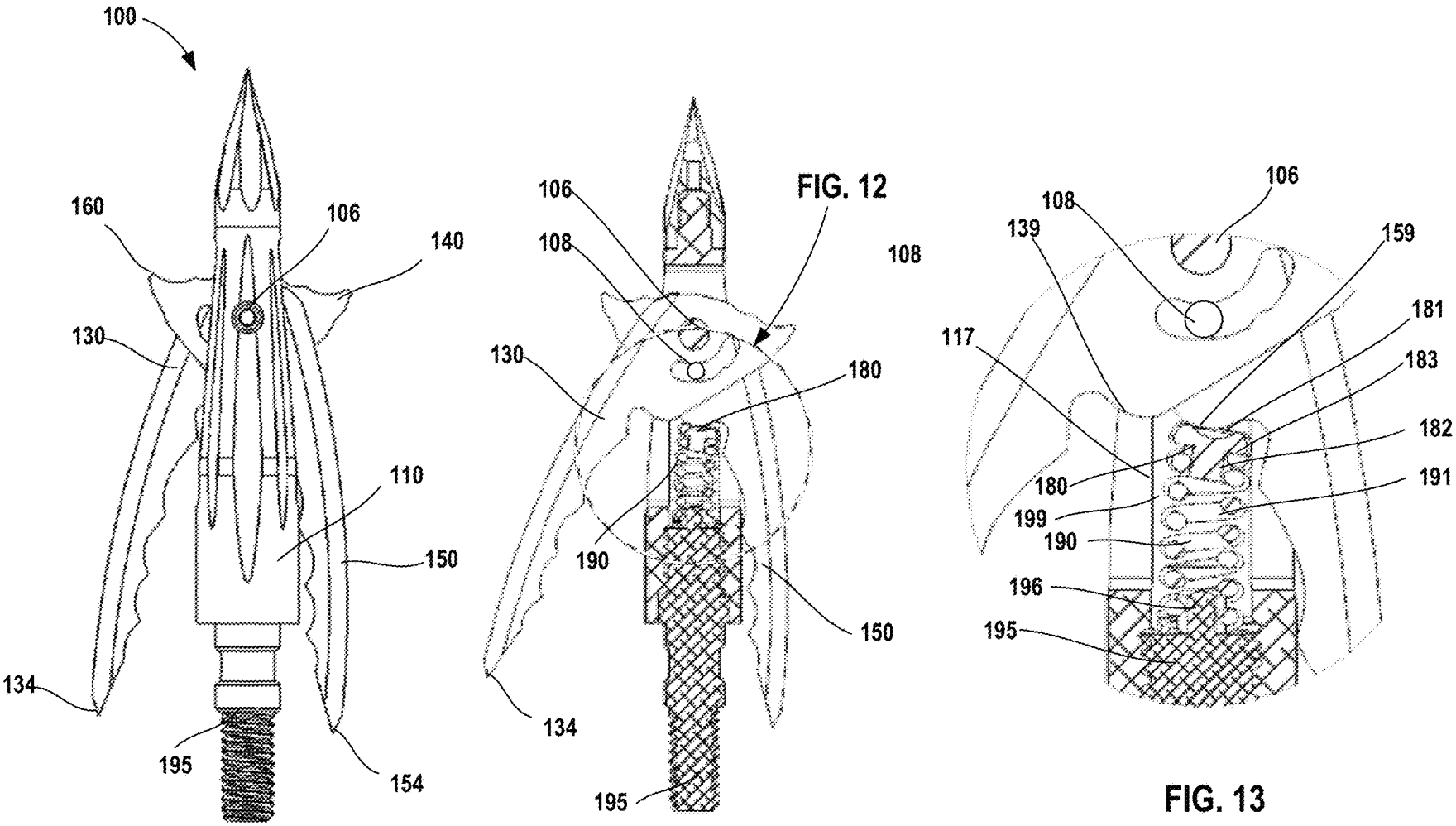
FIG. 11 depicts a front view of the exemplary arrowhead of FIG. 1 with the blades in a transition from a stowed position to a deployed position, according to aspects described herein.
FIG. 12 cross-sectional view of the exemplary arrowhead of FIG. 1 similar to FIG. 8 with the blades in a transition from a stowed position to a deployed position, according to aspects described herein.
FIG. 13 depicts an enlarged view of the cross-sectional view of FIG. 12, according to aspects described herein.

To illustrate the deployment of both blades simultaneously, FIGS. 11-13 illustrate a moment during blade deployment where one of the blade deployment tabs 140 has been rotated toward the ferrule 110 resulting in the blade 130 rotating the pivot around its blade pivot pin 106. The force exerted on the deployment tab 140 is greater than the predetermined release force, which is a function of the spring constant of the resilient member 190 and the radius of the concave surface 181 of the blade locking member 180. As such, the distal end 134 begins to rotate outward away from the ferrule 110. Since one blade 130 has started to rotate outward, the system equilibrium between the blades 130, 150, the blade locking member 180, and the resilient member 190 is disrupted and the single blade interaction between the blade locking geometry 159 and the blade locking member 180 cannot keep the upper portion of the resilient member 190 and blade lock member 180 centered in the ferrule cavity 119 since the ferrule cavity 119 has a diameter that is larger than the diameter of the resilient member 190. In some instances, a diameter (or maximum width dimension of the ferrule cavity 119) of the ferrule cavity 119 may be expressed with a ratio of a maximum diameter of the resilient member 190 to the diameter of the ferrule cavity 119. For instance, the ratio of the diameter of the resilient member 190 to a maximum diameter of the ferrule cavity 199 may be within a range of that is within a range of 0.75:1.0 and 0.80:1.0, or within a range of 0.70:1.0 and 0.95:1.0, or within a range of 0.850:1.0 and 0.95:1.0. In other words, the diameter of the resilient member 190 may be within a range of 85 percent of the diameter of the ferrule cavity 119 and 80 percent of the diameter of the ferrule cavity 119, or the maximum diameter of the resilient member 190 may be within a range of 70 percent of the diameter of the ferrule cavity 119 and 80 percent of the diameter of the ferrule cavity 119, or in other examples, the maximum diameter of the resilient member may be within a range of 70 percent of the diameter of the ferrule cavity 119 and 95 percent of the diameter of the ferrule cavity 119. The diameter of the ferrule cavity 119 may be measured at a location at an approximate center of the longitudinal length of the resilient member 190.

The resilient member 190 may have a free length as defined by a length of the from a first end to an opposite end along a longitudinal axis as known to one skilled in the art. The resilient member 190 may have a free length that allows it to be deformed at least 0.15 inches when the blades 130, 150 are in the stowed position and a spring constant that provides enough force to the blades 130, 150 to deploy when the deployment tabs 140, 160 contact a target. When the blades 130, 150 are in the stowed position, the resilient member 190 may have a stowed length, which is approximately 60 percent of the free length or within a range of 55 percent and 65 percent of the free length, or within a range of 50 percent and 70 percent of the free length. In addition, when at the stowed length, the resilient member 190 may exert a force of approximately 17.5 pounds*force when in the stowed length, or within a range of 13 pounds*force and 21 pounds*force when in the stowed length. When the blades 130, 150 are in the deployed position, the resilient member 190 may have a deployed length that is approximately 80 percent of the free length or within a range of 60 percent (when one or more blades are deflected inwardly by a hardened region of the target) and 90 percent of the free length. In the deployed position, the resilient member 190 may exert a force of approximately 8.7 pounds*force, or within a range 4.4 pounds*force and 17.5 pounds*force.

Since the resilient member 190 acts in accordance with its spring constant, the remaining blade 150 may exert less force on the resilient member 190 individually than when the pair of blades 130 were engaged with the resilient member 190. As the resilient member 190 (i.e., the compression spring) attempts to return to its free length, an upward force is created causing the upper portion of the resilient member 190 to deform in such a way that directs the stored energy toward the blade 150 still engaged with the blade lock member 180. Since the blade 150 is rotationally attached along the longitudinal axis 101, the upper portion of the resilient member 190 may deform such that the force from the resilient member 190 is now in a direction that is no longer coaxial with the longitudinal axis 101 and is in a direction that causes the blade 150 to rotate outward away from the ferrule 110, such that the blade 150 moves to its deployed position.

FIGS. 10A-10B illustrate the blades 130, 150 in a deployed position with the ferrule 110 removed for clarity. Once deployed, the blade deployment geometry 141, 161 may contact the blade locking member 180. In some examples, the blade deployment geometry 141, 161 may comprise generally flat surface such that the blade deployment geometry 141 only contacts an upper edge of the concave surface 181. By contacting an upper edge of the concave surface 181, the blade deployment geometry 141, 161 may slidably engage the blade locking member 180 to allow the blades 130, 150 to rotate inward independently if they contact a hardened surface that will overcome the force exerted by the resilient member 190 when the blades 130, 150 are in the deployed position. However, due the equilibrium of forces between the resilient member 190, the blade locking geometry 139, 159, and the blade locking member 180, the blades 130, 150 cannot be moved from a deployed position back to a stowed position unless a protuberance 138, 158 of each blade 130, 150 contacts the outer surface 113 of the ferrule 110 simultaneously to reestablish equilibrium. Otherwise, the resilient member 190 may continue to impart an uneven force on the blades 130, 150 such that the uneven forces prevent the blades 130, 150 from moving back to a stowed position.

In the examples that include a guide slot and guide pin, as best shown in FIG. 10A, when blades are in the deployed position, the respective guide slots 142, 162 move with respect to the guide pin 108 until the guide pin 108 contacts the raised stop surfaces 145, 165. Thus, when in the deployed position, the guide pin 108 is between the corresponding stop surfaces 145, 165 of each blade 130, 150. The stop surfaces 145, 165 prevent over-rotation of the blades 130, 150 and help to assure the blades 130, 150 are in a predetermined deployed position.

Figure 16:
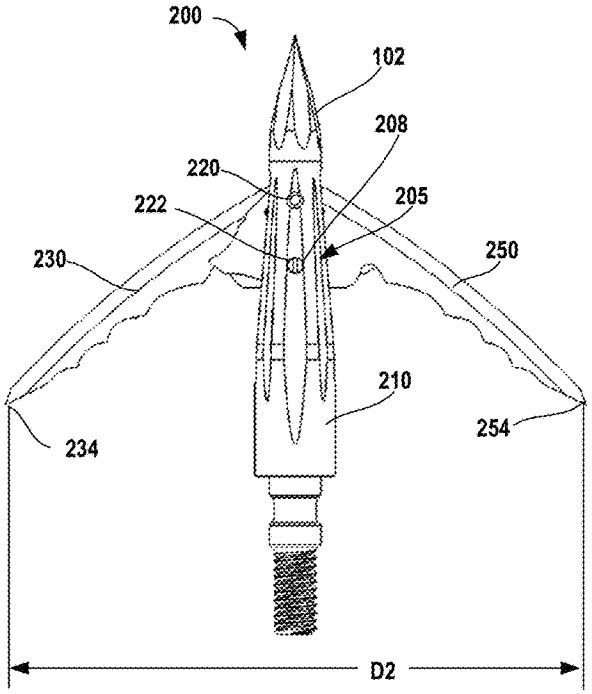
FIG. 16 depicts a front view of the exemplary arrowhead of FIG. 14 with the blades in a second deployed position, according to aspects described herein.
Figure 15:
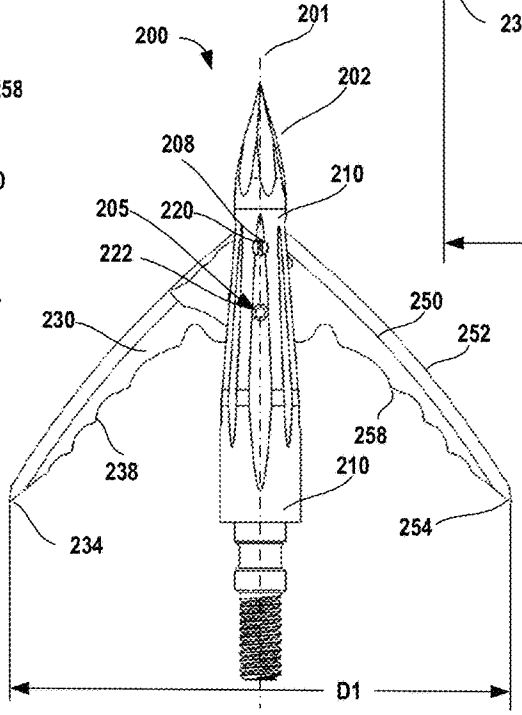
FIG. 15 depicts a front view of the exemplary arrowhead of FIG. 14 with the blades in a first deployed position, according to aspects described herein.
Figure 14:
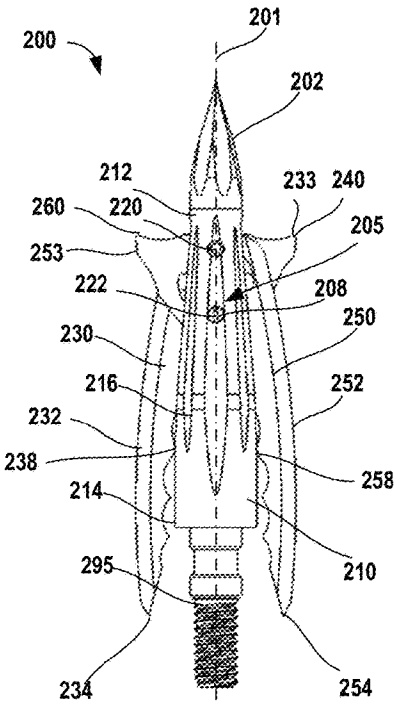
FIG. 14 depicts a front view of an alternate exemplary arrowhead with the blades in a stowed position, according to aspects described herein.

FIGS. 14-26 illustrate arrowhead 200. The features of arrowhead 200 are referred to using similar reference numerals under the "2xx" series of reference numerals, rather than "1xx" as used in the exemplary arrowhead 100 shown in FIGS. 1-13. Accordingly, certain features of the arrowhead 200 that were already described above with respect to arrowhead 100 of FIGS. 1-13 may be described in lesser detail, or may not be described at all. Arrowhead 200 may be similar to arrowhead 100 except the deployed position of the blades 130, 150 may be adjusted to have different diameter cutting diameters as shown in FIGS. 14-26. FIG. 14 illustrates arrowhead 200 with the blades 230, 250 in a stowed position, while FIGS. 15-16 illustrate front views of the arrowhead with the blades 230, 250 in a deployed position. The arrowhead 200 may include a longitudinal axis 201 along a centerline of the arrowhead 200. In some examples, arrowhead 200 with the blades 230, 250 in a stowed position where the blades 230, 250 may contact an outer surface of the ferrule 210, while FIGS. 15-16 illustrate the blades 230, 250 in a deployed position, where the distal ends 234, 254 of the blades 230, 250 are extended away from the outer surface of the ferrule 210 at a distance that is greater than when in the stowed position. The arrowhead may have a plurality of deployed positions, where a first deployed position may comprise the deployed blades 230, 250 extending to reach a first maximum cutting diameter, D1, as shown in FIG. 15 and a second deployed position may comprise that the deployed blades 230, 250 extending to reach a first maximum cutting diameter, D2, as shown in FIG. 16. The maximum cutting diameters, D1 and D2, may be measured as a horizontal distance between the distal ends 234, 254 of the blades 230, 250. In the illustrated example, the arrowhead 200 may include a resilient member 290, such as a compression spring, that allows the blades 230, 250 to fluctuate or change in cutting diameter while penetrating a target, such that each blade 130, 150 may deflect inward independently when contacting a hardened region of a target, such as a bone.

Arrowhead 200 may also include an adjustment mechanism 205. The adjustment mechanism 205 may comprise a mechanical fastener 208 that acts like guide pin, where the mechanical fastener 208 may be received in either a first blade adjustment opening 220 or a second blade adjustment opening 222 to create two distinct deployed positions with each the blades 230, 250 having being able to extend to a different maximum diameter, D1 or D2, in each deployed position. For example, the arrowhead 200 illustrated in FIG. 15 includes the blades 230, 250 extending to a maximum cutting diameter D1, while the arrowhead 200 of FIG. 16 shows the blades 230, 250 extending to a maximum cutting diameter, D2. The maximum cutting diameter D1 may be less than the maximum cutting diameter, D2.

The ferrule 210 may comprise a first end 212, a second end 214, and a ferrule body 216 that extends between the first end 212 and the second end 214. The point 202 may be a separate component fixedly or removably connected to the first end 212. Alternatively, the ferrule 210 may be integrally formed with a point 202 at the first end 212. The ferrule body 216 may also include a blade pivot hole 218 that defines a blade pivot axis, a first blade adjustment opening 220, and a second blade adjustment opening 222. The blade pivot hole 218 may be centered along the longitudinal axis 201 of the arrowhead 200. In some examples, the blade adjustment openings 220, 222 may also be centered along the longitudinal axis 201.

Blade 230 may have a cutting portion 232, which may be located on an exterior edge of the blade 230 with a distal end 234. In addition, blade 230 may include a blade pivot aperture 236 that receives a blade pivot pin 206 that also extends into the blade pivot hole 218. A plurality of protuberances 238 may be arranged on an opposite side from the cutting portion 232. The blade 230 may also include a locking geometry 239 that interacts with a blade locking member 280 when the arrowhead 100 is in a stowed position. In addition, blade 230 may include a deployment tab 240 at a first end 233 opposite the distal end 234 to assist in the deployment of the blade 230 and a deployment geometry 241 that that interacts with a blade locking member 280 when the arrowhead 200 is in a deployed position. The blade 230 may also have a first guide slot 242 that may selectively receive the mechanical fastener 208 when the mechanical fastener is received in the first blade adjustment opening 220 of the ferrule 210 and a second guide slot 246 that may selectively receive the mechanical fastener 208 when the mechanical fastener is received in the second blade adjustment opening 222 of the ferrule 210. The first guide slot 242 may be located above (i.e. closer to the first end 212 of the ferrule 210) and spaced from the blade pivot aperture 236. The second guide slot 246 may be located below (i.e. closer to the second end 214 of the ferrule 210) and spaced from the blade pivot aperture 236. Each guide slot 242, 246 may have a curved shape, where the curved shape of may be centered on the blade pivot aperture 236. The guide slots 242, 246 may each comprise an inboard surface 243, an outboard surface 244, and a raised stop surface 245 along the outboard surface 244.

Similarly, blade 250 may have a cutting portion 252, which may be located on an exterior edge of the blade 250 with a distal end 254. In addition, blade 250 may include a blade pivot aperture 256 that receives a blade pivot pin 206 that also extends into the blade pivot hole 218. A plurality of protuberances 258 may be arranged on an opposite side from the cutting portion 252. The blade 250 may also include a locking geometry 259 that interacts with a blade locking member 280 when the arrowhead 200 is in a stowed position. In addition, blade 250 may include a deployment tab 260 at a first end 253 opposite the distal end 254 to assist in the deployment of the blade 250 and a deployment geometry 261 that that interacts with a blade locking member 280 when the arrowhead 200 is in a deployed position. The blade 250 may also have a first guide slot 262 that may selectively receive the mechanical fastener 208 when the mechanical fastener is received in the first blade adjustment opening 220 of the ferrule 210 and a second guide slot 266 that may selectively receive the mechanical fastener 208 when the mechanical fastener is received in the second blade adjustment opening 222 of the ferrule 210. The first guide slot 262 may be located above (i.e., closer to the first end 212 of the ferrule 210) and spaced from the blade pivot aperture 256. The second guide slot 266 may be located below (i.e., closer to the second end 214 of the ferrule 210) and spaced from the blade pivot aperture 256. Each guide slot 262, 266 may have a curved shape, where the curved shape of may be centered on the blade pivot aperture 256. The guide slots 262, 266 may each comprise an inboard surface 243, an outboard surface 244, and a raised stop surface 245 along the outboard surface 244.

Figure 25:
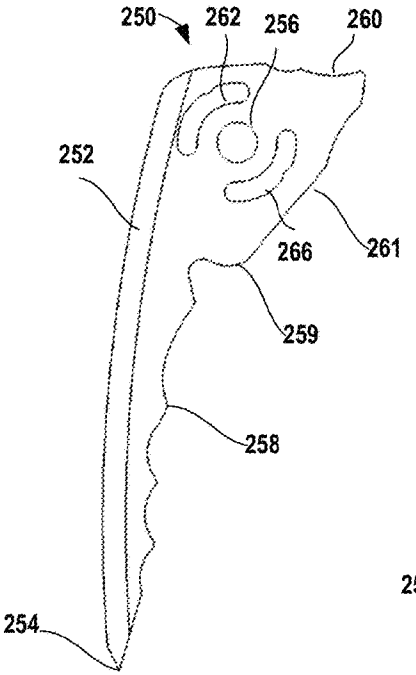
FIG. 25 depicts a front view of a blade of the exemplary arrowhead of FIG. 14, according to aspects described herein.
Figure 26:
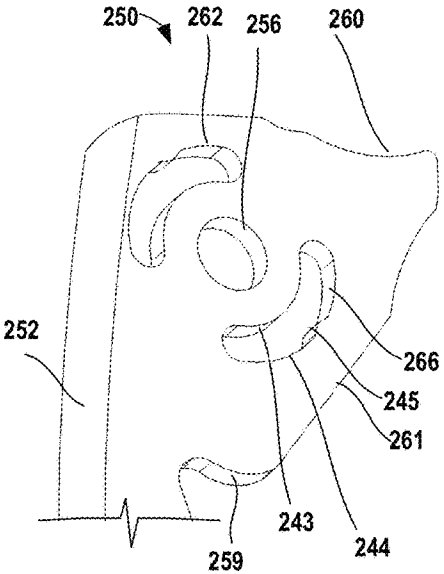
FIG. 26 depicts a partial perspective view of the blade of FIG. 25, according to aspects described herein.

In some examples, the first guide slots 242, 262 may be mirror images of the second guide slots 246, 266 when mirrored through a plane that extends through the blade pivot apertures 236, 256. In other examples, the distance from the first guide slots 246, 266 may be closer to their respective blade pivot apertures 236, 256 than the distance from the second guide slots 246, 266 to their respective blade pivot apertures 236, 256 as shown in FIGS. 25-26. The position of the stop surface 245 along the outboard surface 244 may act to interact with the guide pin 208 to cause the deployed blades 130, 150 to deploy to the desired maximum diameters, D1 and D2.

Figure 18:
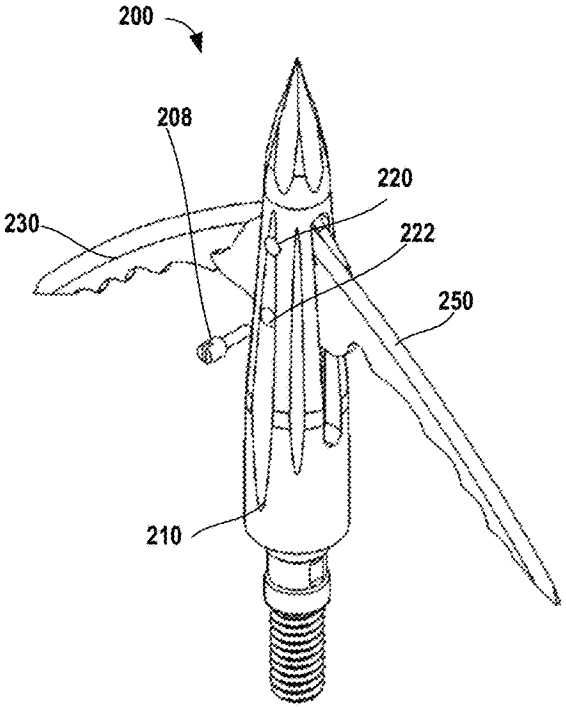
FIG. 18 depicts a partially exploded front perspective view of the exemplary arrowhead of FIG. 14 with the blades in a second deployed position, according to aspects described herein.
Figure 17:
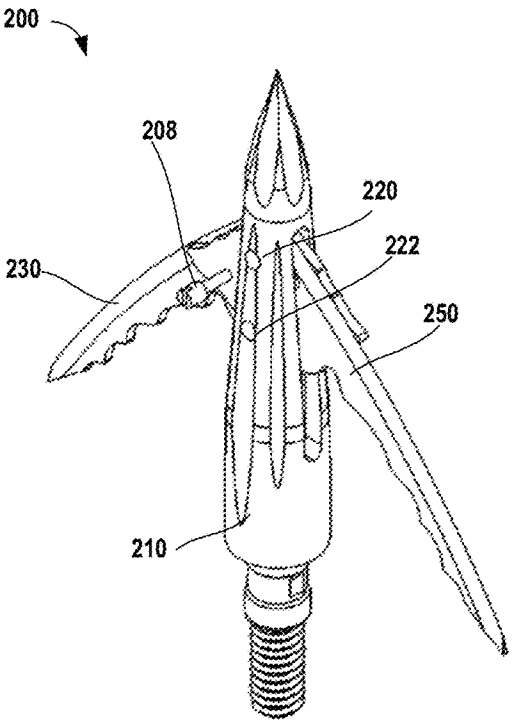
FIG. 17 depicts a partially exploded front perspective view of the exemplary arrowhead of FIG. 14 with the blades in a first deployed position, according to aspects described herein.

As shown in FIGS. 17 and 18, when the mechanical fastener 208 is located in the first blade adjustment opening 220, the blades 230, 250 may deploy to a maximum diameter, D1, and when the mechanical fastener 208 is located in the second blade adjustment opening 222, the blades 230, 250 may deploy to a maximum diameter, D2.

Figure 20:
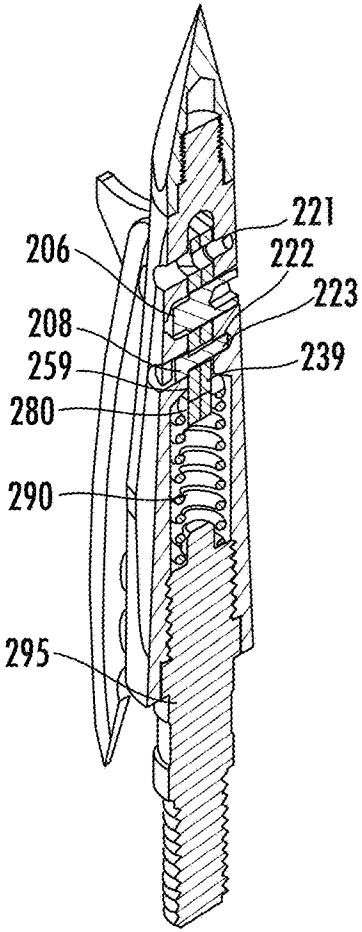
FIG. 20 depicts a cross-sectional perspective view of the exemplary arrowhead of FIG. 14 with the blades in a stowed position, according to aspects described herein.
Figure 19:
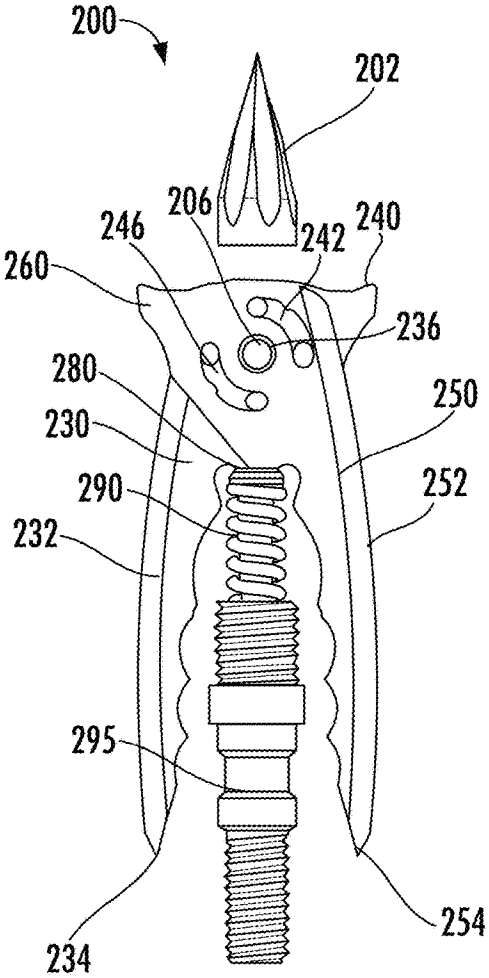
FIG. 19 depicts a front view of the exemplary arrowhead of FIG. 14 with the blades in a stowed position with some components removed for clarity, according to aspects described herein.

FIG. 19 illustrates the arrowhead 200 without the ferrule 210, while FIG. 20 illustrates a cross-sectional view of arrowhead 200. Arrowhead 200 may include a similar arrangement regarding the interaction between the blades 230, 250, the resilient member 290, and the blade locking member 280 as arrowhead 100 described above. Thus, the blades 230, 250 may interact similarly when moving from a stowed position to a deployed position as blades 130, 150 described above. The resilient member 290 may be positioned between the stem 295 that releasably engages the ferrule 210 and the blade locking member 280.

Figure 22:
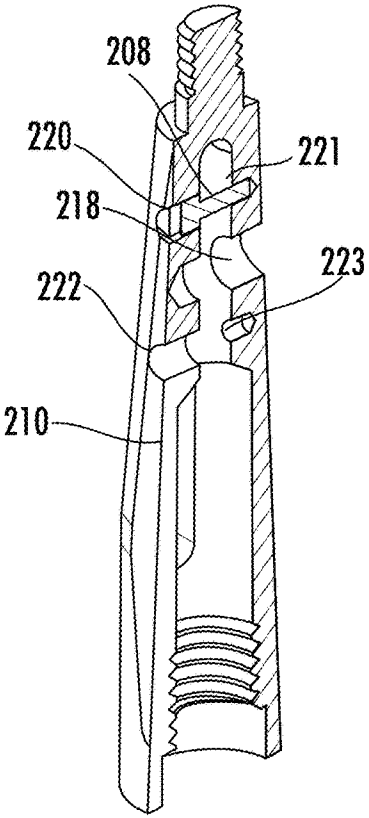
FIG. 22 depicts a cross-sectional perspective view of the exemplary arrowhead of FIG. 14 with the blades in a stowed position with some components removed for clarity, according to aspects described herein.
Figure 21:
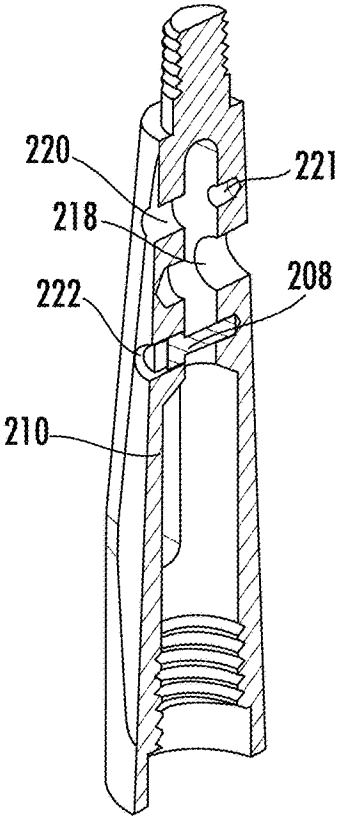
FIG. 21 depicts a cross-sectional perspective view of the exemplary arrowhead of FIG. 14 with the blades in a stowed position with some components removed for clarity, according to aspects described herein.

FIGS. 21 and 22 illustrate cross-sectional views of the ferrule 210 selectively receiving the mechanical fastener 208 into the first blade adjustment opening 220 in FIG. 21 and the mechanical fastener 208 being selectively received in the second blade adjustment opening 222 in FIG. 22. The ferrule 210 may include a threaded portions 221, 223 to releasably receive the mechanical fastener 208. In addition, the mechanical fastener 208 may include a shoulder portion that has a smooth diameter such that the shoulder interacts with the inboard and outboard surfaces 243, 244 of the guide slots 242, 246, 262, 266 as well as the stop surfaces 245 to control the cutting diameter when the blades 230, 250 are in a deployed position. In some examples, the mechanical fastener 208 may have a plurality of shoulder portions each with a different diameter. The first shoulder may have a diameter that is smaller than a threaded portion of the fastener 208 and the second shoulder may have a diameter that is greater than the diameter of the threaded portion. The first shoulder may be received within the guide slots 242, 246, 262, 266 to control the cutting diameter when the blades 230, 250 are in a deployed position. Additionally, the smaller diameter of the first shoulder may allow the fastener 208 to be moved past the stop surfaces 245 in conditions when the blades 230, 250 are rotated forward to allow for removal of the arrowhead 200 from a target.

Figure 23:
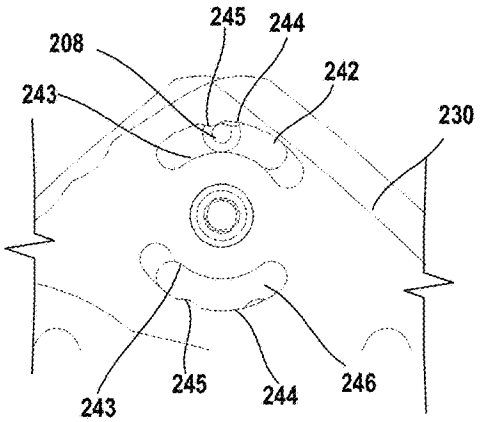
FIG. 23 depicts a front view of a portion of the exemplary arrowhead of FIG. 14 in a first deployed position with some components removed for clarity, according to aspects described herein.
Figure 24:
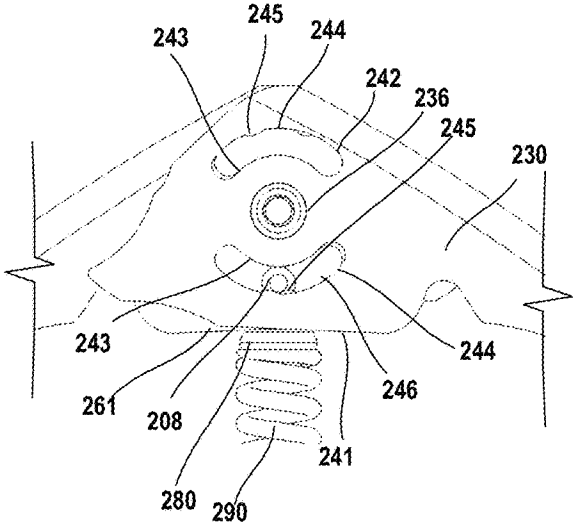
FIG. 24 depicts a front view of a portion of the exemplary arrowhead of FIG. 14 with the blades in a second deployed position with some components removed for clarity, according to aspects described herein.

FIG. 23 illustrates a front schematic view of the mechanical fastener 208 engaged with the first guide slots 242, 262 when the blades 230, 250 are in a first deployed position. The mechanical fastener 208 may contact the stop surfaces 245 of each of the first guide slots 242, 262 when the blades 230, 250 are in the first maximum deployed position. Similarly, FIG. 24 illustrates a front schematic view of the mechanical fastener 208 engaged with the second guide slots 246, 266 when the blades 230, 250 are in a second deployed position. The mechanical fastener 208 may contact the stop surfaces 245 of each of the second guide slots 242, 262 when the blades 230, 250 are in the second maximum deployed position.

Figure 28:
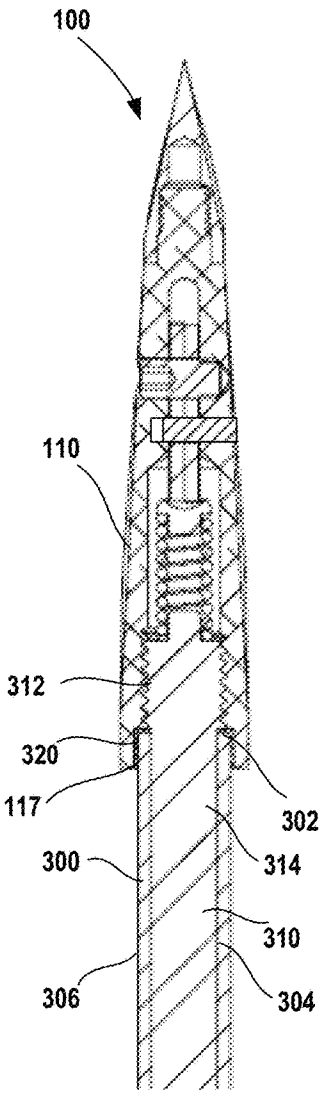
FIG. 28 depicts a front cross-sectional view of the assembly of the exemplary arrowhead of FIG. 1 onto an arrow shaft, according to aspects described herein.
Figure 27:
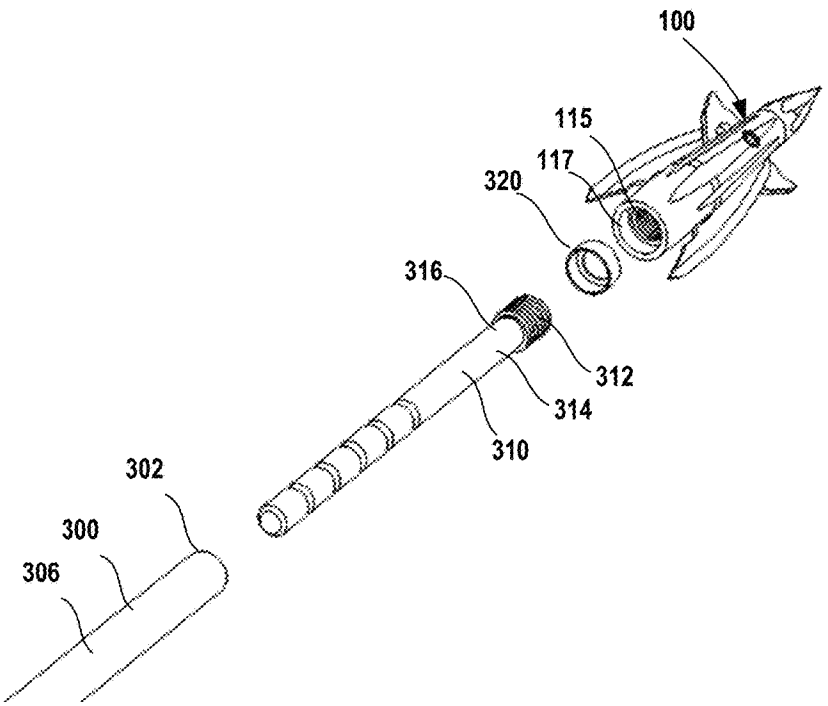
FIG. 27 depicts an exploded perspective view of the assembly of the exemplary arrowhead of FIG. 1 onto an arrow shaft, according to aspects described herein.

FIGS. 27-28 illustrate an alternate attachment to an arrow shaft 300 for arrowheads 100, 200 described above. While the illustrated example shown in FIGS. 27-28 is depicted with arrowhead 100, the same arrangement may be used with arrowhead 200. The stem 195 described above may be replaced with stem 310. Stem 310 may include a threaded portion 312 that releasably engages an internally threaded portion 115 the second end 114 of ferrule 110. The stem 310 has a reduced diameter immediately adjacent the threaded portion 312 which leaves a gap between an exterior surface 316 of the stem 310 and an interior surface 117 of the ferrule 110. The interior surface 117 may form a counterbore at the second end 114 of the ferrule 110. The gap allows for an end 302 of the arrow shaft 300 to be inserted into the second end 114 of the ferrule 110. Thus, the end 302 of the arrow shaft 300 is received within the second end 114 to add additional support to the end 302 of the arrow shaft 300. This may enhance the durability of the connection region of the arrowhead 100 and of the arrow shaft 300. The end 302 of the arrow shaft 300 may form a slip fit with the counterbore portion of the ferrule 110. So, while the stem 310 may have a lower portion 314 received into an interior bore 304 of the arrow shaft and the counterbore region surrounds an exterior surface 306 of the end 302 of the arrow shaft 300. The overlap generated between the end 302 of the arrow shaft and the counterbore of the ferrule 110 help prevent damage to the arrow shaft 300 to reduce failure during impact with a hard surface (or break out the sidewall of the carbon fiber arrow) without the need for additional parts/pieces. This overlapped construction with the lower portion 314 inserted into an opening of the arrow shaft 300 provides increased strength of the joint between the arrow shaft 300 and the arrowhead 100 when compared to an arrow shaft 300 positioned adjacent the second end 114 of a ferrule 110. Depending on the size of the external diameter of the arrow shaft 300, a spacer 320 may be added to the end 302 of the shaft 300 such that the same ferrule 110 may be used for multiple arrow shaft sizes. In some examples, the lower portion of the stem 310 is secured into the interior of the shaft 300 using an adhesive or other means known to one skilled in the art, which allows the stem 310 and arrow shaft 300 combination to be releasably engaged with the arrowhead 100 by the threaded portion 312 of the ferrule 110. In some examples, the end 302 of the arrow shaft 300 may be connected to the ferrule 110 using an adhesive.

Figure 29:
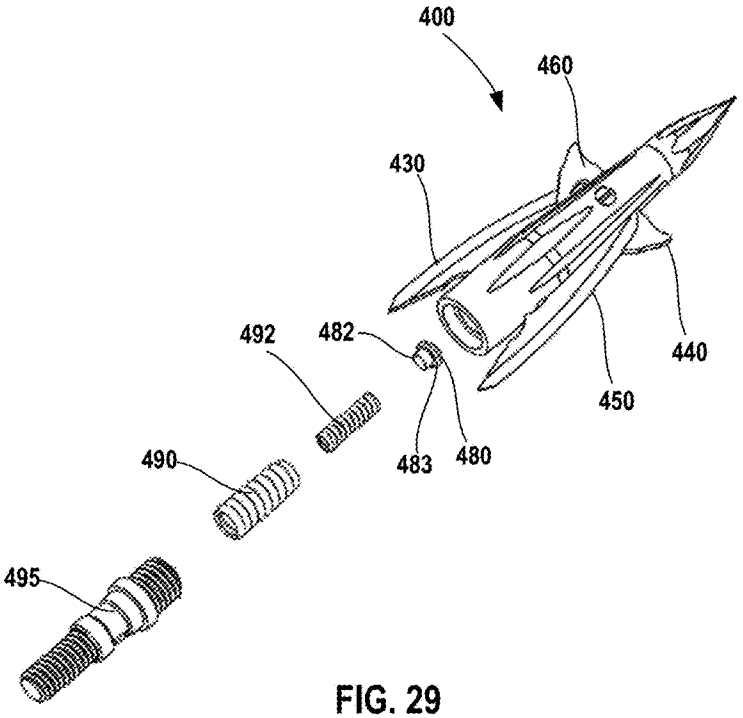
FIG. 29 depicts an exploded a perspective view of an alternate exemplary arrowhead with the blades in a stowed position, according to aspects described herein.
Figure 30:
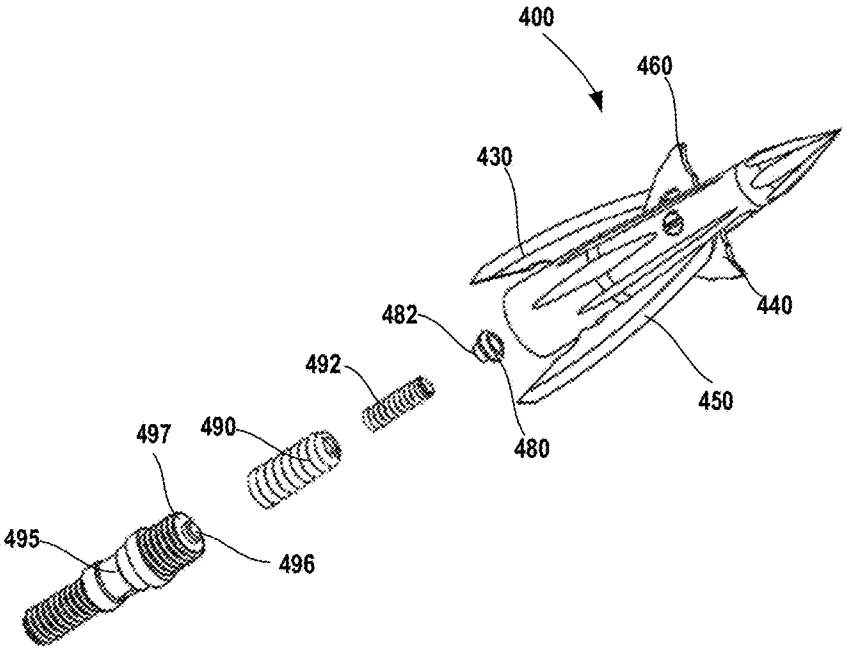
FIG. 30 depicts an exploded a perspective view of the exemplary arrowhead of FIG. 29 with the blades in a stowed position, according to aspects described herein.
Figure 32:
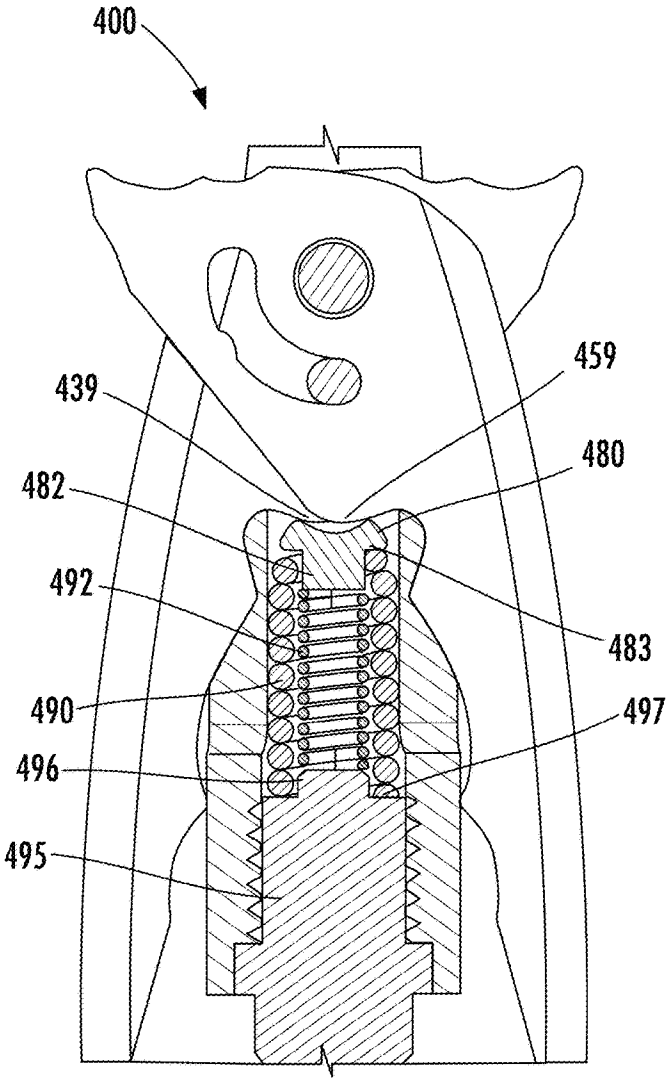
FIG. 32 depicts an enlarged view of the cross-sectional front view of FIG. 31, according to aspects described herein.
Figure 31:
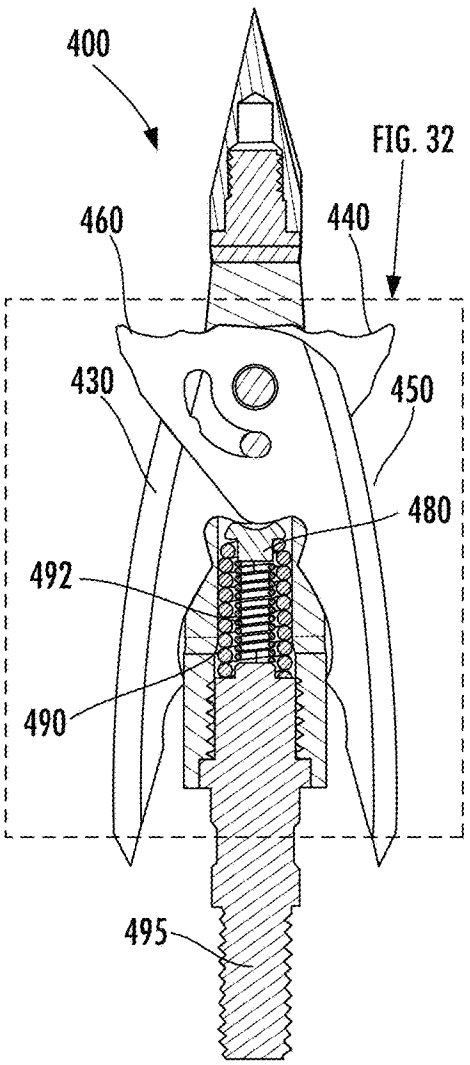
FIG. 31 depicts a cross-sectional front view of the exemplary arrowhead of FIG. 29 with the blades in a stowed position, according to aspects described herein.
Figure 34:
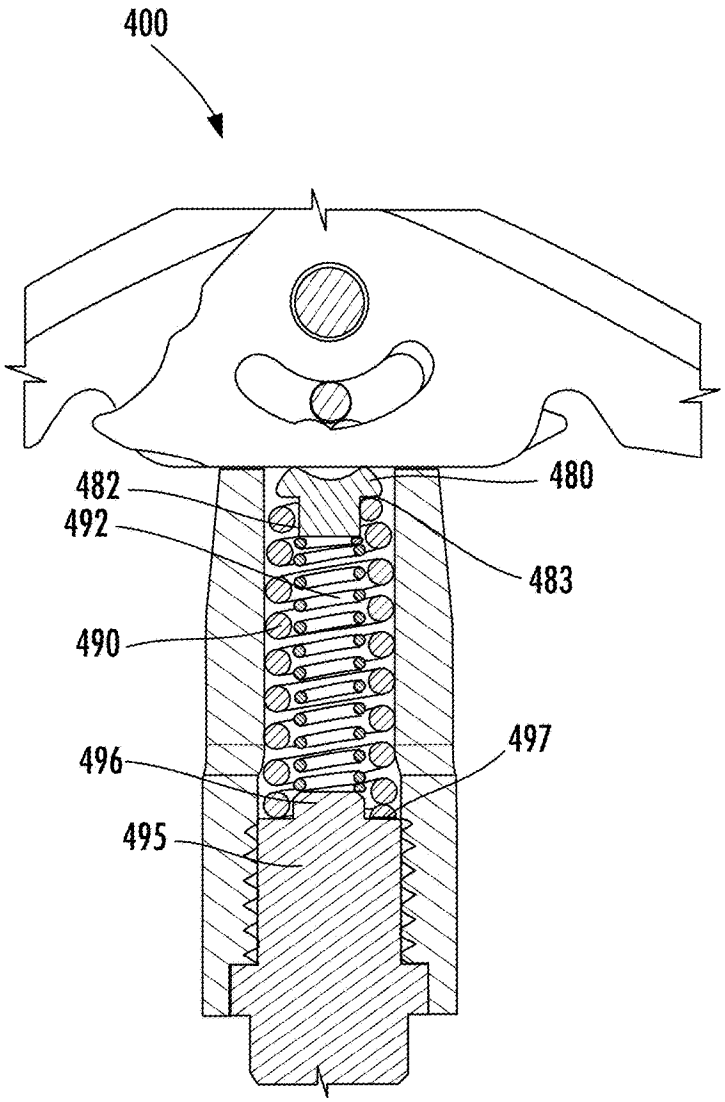
FIG. 34 depicts an enlarged view of the cross-sectional front view of FIG. 33, according to aspects described herein.
Figure 33:
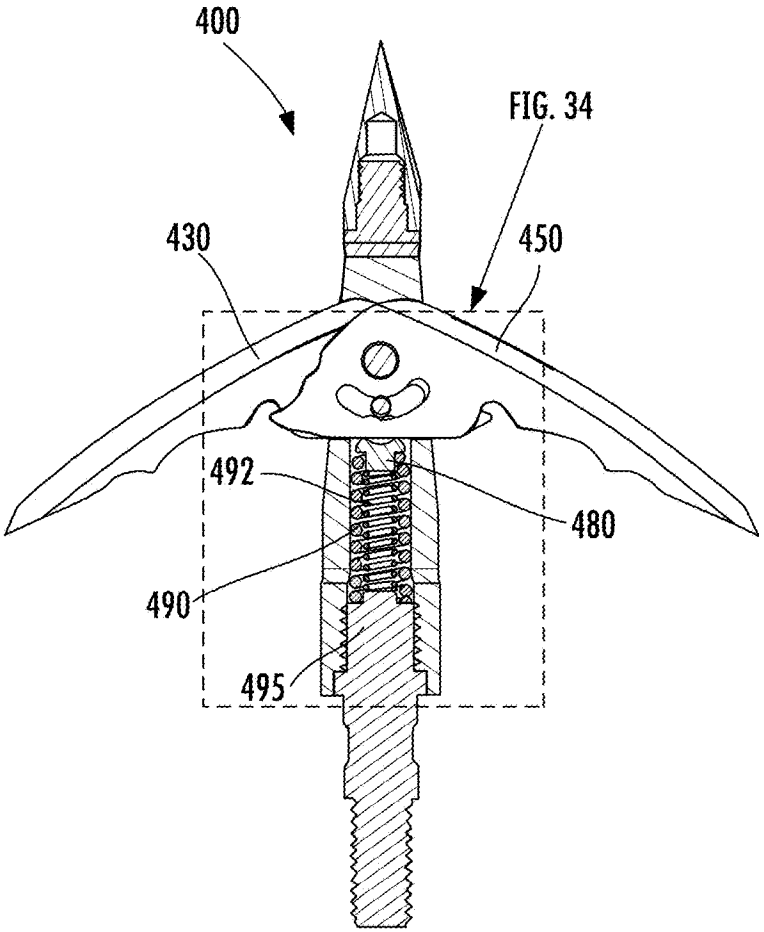
FIG. 33 depicts a cross-sectional front view of the exemplary arrowhead of FIG. 29 with the blades in a deployed position, according to aspects described herein.

FIGS. 29-34 illustrate arrowhead 400. The features of arrowhead 400 are referred to using similar reference numerals under the "4xx" series of reference numerals, rather than "1xx" as used in the exemplary arrowhead 100 shown in FIGS. 1-13. Accordingly, certain features of the arrowhead 400 that were already described above with respect to arrowhead 100 of FIGS. 1-13 may be described in lesser detail, or may not be described at all. Arrowhead 400 may be similar to arrowhead 100 except the resilient member 190 may be replaced by a pair of nested resilient members 490, 492. FIGS. 29-30 illustrates exploded views of arrowhead 400 with the first resilient member 490 and the second resilient member 492. The second resilient member 492 may be nested within the first resilient member 490 such that the first resilient member 490 surrounds the second resilient member 492. Both the first resilient member 490 and the second resilient member 492 may provide a force to move the blades 430, 450 from a stowed position to a deployed position, where a first distance between a distal end of the first blade and an outer surface of the ferrule is greater when the first blade is in the deployed position than in the stowed position. FIGS. 31-32 illustrate front cross-sectional views of arrowhead 400 with the blades 430, 450 in a stowed position, while FIGS. 33-34 illustrate front cross-sectional views of the arrowhead with the blades 430, 450 in a deployed position. Optionally, the nested resilient members 490, 492 may comprise a triple set of nested resilient members that comprises three nested resilient members, where the resilient members may be three compression springs.

As shown in FIGS. 31-34, the second resilient member 492 may be positioned between and also in contact with the central protrusion 482 of the blade locking member 480 and the central protrusion 496 of the stem 495. The first resilient member 490 may be in contact with the upper surface 497 of the stem 495 and the lower surface 483 of the blade locking member 480. In addition, the outer diameter of the second resilient member 492 may be less than the inner diameter of the first resilient member 490 such that the second resilient member 492 is free of contact with the first resilient member 490 when in the compressed state and/or any interaction between the two resilient members 490, 492 does not inhibit them movement from a compressed state to a free state. In some examples, the first resilient member 490 and the second resilient member 492 may both be compression springs. The compression springs 490, 492 may be a steel round wire compression spring. The first resilient member 490 may also have a first free length that is greater than a second free length of the second resilient member 492. The first resilient member 490 may also have a greater compressed length than the second resilient member 492. In some instances, the free length of the first resilient member 490 may be approximately 20 percent longer or within a range of 10 percent and 30 percent longer than the second resilient member 492.

Each resilient member 490, 492 may provide a different spring force to help the blades 430, 450 to consistently deploy when one of the deployment tabs 440, 460 contacts a target. The combination of both spring forces allows for any movement of the one of the blades 430, 450 caused by the contact of either deployment tab 440, 460 to cause movement of the blade locking member 480, which leads to the release of the locking geometry 439, 459 from the blade locking member 480 and the subsequent deployment of the blades 430, 450. The nested spring configuration allows for a relatively small movement of either locking geometry 439, 459 to cause release the forces of the compressed resilient members 490, 492 resulting in the deployment of the blades 430, 450. The first resilient member 490 may have a first spring constant that is larger than a second spring constant of the second resilient member 492. The first resilient member 490 may have similar length and spring constant properties similar to the resilient member 190 above. Additionally, the second resilient member 492 may have a free length as defined by a length of the from a first end to an opposite end along a longitudinal axis as known to one skilled in the art. The resilient members 490, 492 may each have a free length that allows them to be deformed at least 0.15 inches when the blades 430, 450 are in the stowed position to provide enough force to the blades 430, 450 to deploy when the deployment tabs 440, 460 contact a target. When the blades 430, 450 are in the stowed position, the resilient member 490 may have a stowed length, which is approximately 60 percent of the free length or within a range of 55 percent and 65 percent of the free length, or within a range of 50 percent and 70 percent of the free length. The resilient member 492 may have a stowed length, which is approximately 50 percent of the free length or within a range of 45 percent and 55 percent of the free length, or within a range of 40 percent and 60 percent of the free length. In addition, when at the stowed length, the resilient member 490 may exert a force of approximately 17.5 pounds*force when in the stowed length, or within a range of 13 pounds*force and 21 pounds*force when in the stowed length. The resilient member 492 when at the stowed length may exert a force of approximately 3.8 pounds*force when in the stowed length, or within a range of 3.1 pounds*force and 4.4 pounds*force when in the stowed length. When the blades 430, 450 are in the deployed position, the resilient member 490 may have a deployed length that is approximately 80 percent of the free length or within a range of 60 percent (when one or more blades are deflected inwardly by a hardened region of the target) and 90 percent of the free length. The resilient member 492 may have a deployed length, which is approximately 77 percent of the free length or within a range of 65 percent and 75 percent of the free length, or within a range of 60 percent and 90 percent of the free length. In the deployed position, the resilient member 490 may exert a force of approximately 8.7 pounds*force, or within a range 4.4 pounds*force and 17.5 pounds*force, and the deployed position, the resilient member 492 may exert a force of approximately 1.8 pounds*force, or within a range of 1.5 pounds*force and 2.2 pounds*force.

In some examples, the first spring constant may be approximately 4.5 times greater than the second spring constant, or the first spring constant may be within a range of 4 to 5 times greater than the second spring constant. Thus, for a similar deflection distance, the first resilient member 490 may provide approximately 4.5 times more force than the second resilient member 492. Additionally, once the blades 430, 450 are deployed, the resilient members 490, 492 may provide a combined spring force (i.e. the sum of the spring forces of the first resilient member 490 and the second resilient member 492) to keep the blades 430, 450 deployed. In some implementations, the combined spring force when the blades 430, 450 are deployed may be approximately 50 percent of the combined spring force when the blades 430, 450 are stowed.

Figure 36:
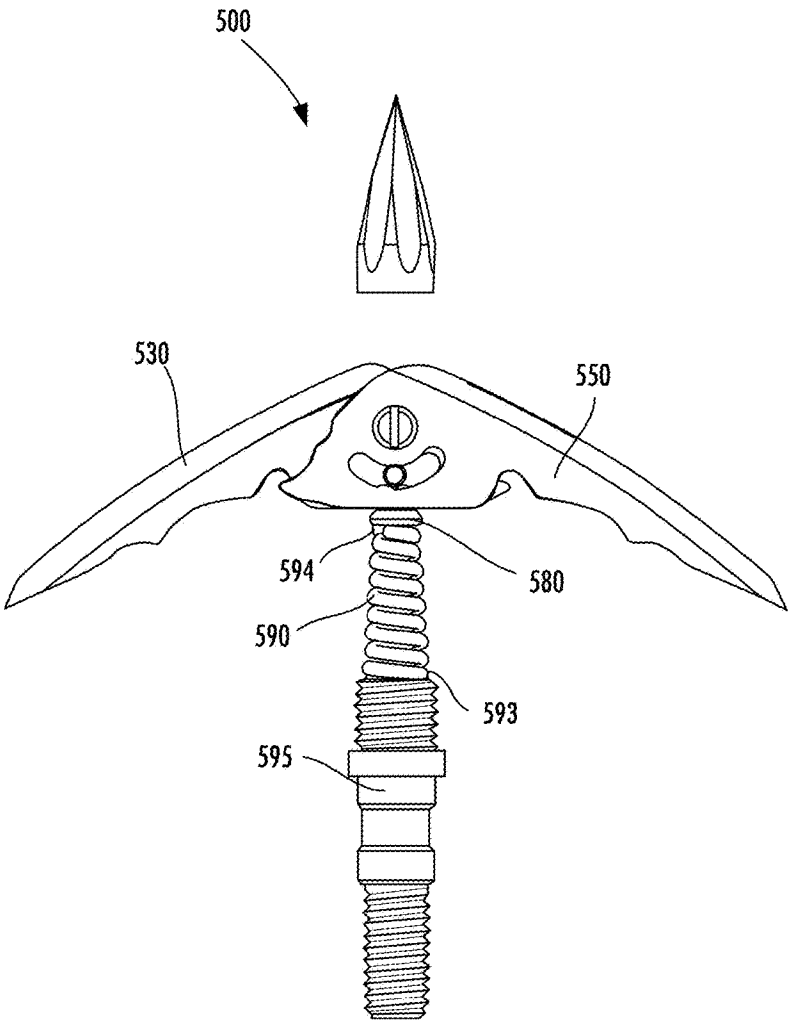
FIG. 36 depicts a front view of the arrowhead of FIG. 31 with some components removed for clarity, according to aspects described herein.
Figure 35:
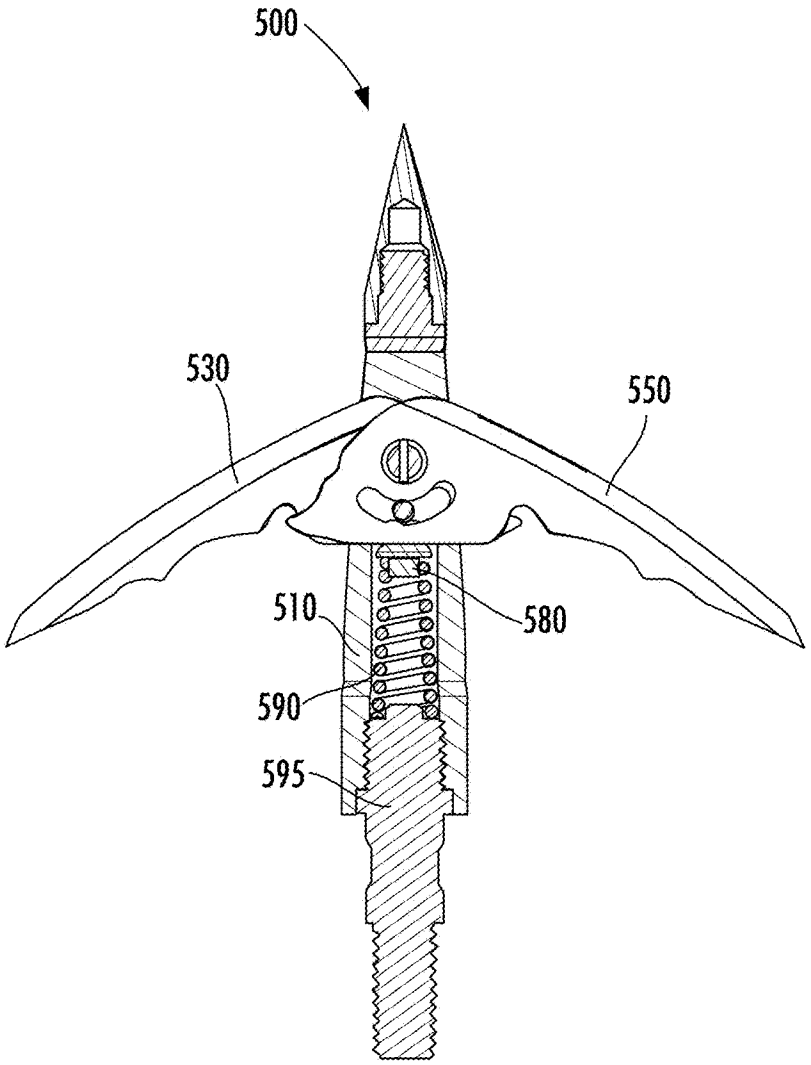
FIG. 35 depicts a cross-sectional front view of an alternate exemplary arrowhead of FIG. 1 with the blades in a deployed position, according to aspects described herein.
Figure 37:
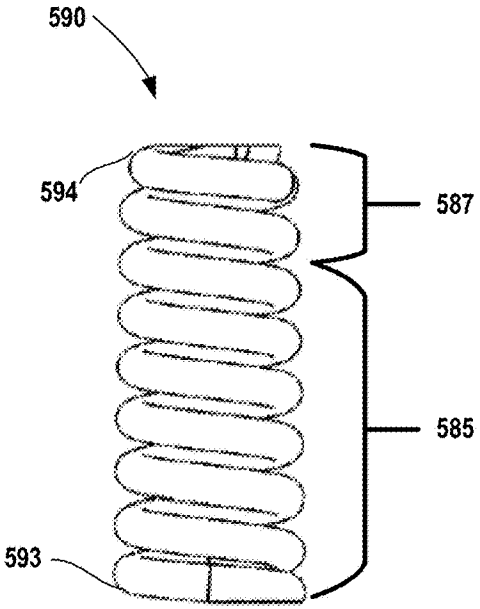
FIG. 37 depicts a front view of an alternate resilient member for the arrowhead of FIG. 35, according to aspects described herein.

FIGS. 35-37 illustrate arrowhead 500. The features of arrowhead 500 are referred to using similar reference numerals under the "5xx" series of reference numerals, rather than "1xx" as used in the exemplary arrowhead 100 shown in FIGS. 1-13. Accordingly, certain features of the arrowhead 500 that were already described above with respect to arrowhead 100 of FIGS. 1-13 may be described in lesser detail, or may not be described at all. Arrowhead 500 may be similar to arrowhead 100 except the resilient member 190 may be replaced by a resilient member 590, where the resilient member 590 has a first end 593 and a second end 594 opposite the first end 593. The first end 593 may have a first diameter and the second end 594 may have a second diameter, where the first diameter is greater than the second diameter. The second diameter may be within a range of 70 percent and 85 percent of the first diameter. The resilient member 590 may provide a force to move the blades 530, 550 from a stowed position to a deployed position. In some examples, the resilient member 590 may have a spring constant that varies along the length of the resilient member 590. For example, the amount of force per length of compression may increase as the resilient member is compressed. Additionally, the smaller diameter at the second end 594 may allow the second end 594 (and the upper portion) of the resilient member 590 to deform or shift from the center of the ferrule cavity to allow for deployment of the blades 530, 550 when one of the deployment tabs 540, 560 contacts a target as shown in FIG. 13 in describing arrowhead 100. FIG. 35 illustrates a front cross-sectional views of arrowhead 500 with the blades 530, 550 in a deployed position while FIG. 36 also illustrates the arrowhead 500 in a deployed position with the ferrule 510 removed for clarity. In some examples, the resilient member 490 may have a similar profile as resilient member 590.

In some examples, the resilient member 590 may have an outer profile that extends between the first end 593 and the second end 594. The outer profile of the resilient member 590 may taper linearly from the first end 593 to the second end 594. Alternatively, the outer profile of the resilient member 590 may have a first portion 585 with a first diameter and a second portion 587 with a second diameter that is smaller than the first diameter. The second portion 587 may be located from the second end 594 and extend along a portion of the length of the resilient member 590. In some instances, the second portion 587 may be approximately 15 percent of a free length of the resilient member 590, or within a range of 10 percent to 20 percent of a free length of the resilient member 590, or within a range of 5 percent to 25 percent of a free length of the resilient member 590. In some examples, the first portion 585 may have a constant diameter, and the second portion 587 may also have a constant diameter with a transition region between the first portion 585 and the second portion 587.

The resilient member 590 may have similar spring properties as resilient member 190. For example, the resilient member 590 may have a free length as defined by a length of the from a first end to an opposite end along a longitudinal axis as known to one skilled in the art. The resilient member 590 may have a free length that allows it to be deformed at least 0.15 inches when the blades 530, 550 are in the stowed position and a spring constant that provides enough force to the blades 530, 550 to deploy when the deployment tabs 540, 560 contact a target. When the blades 530, 550 are in the stowed position, the resilient member 590 may have a stowed length, which is approximately 60 percent of the free length or within a range of 55 percent and 65 percent of the free length, or within a range of 50 percent and 70 percent of the free length. In addition, when at the stowed length, the resilient member 590 may exert a force of approximately 17.5 pounds*force when in the stowed length, or within a range of 13 pounds*force and 21 pounds*force when in the stowed length. When the blades 530, 550 are in the deployed position, the resilient member 590 may have a deployed length that is approximately 80 percent of the free length or within a range of 60 percent (when one or more blades are deflected inwardly by a hardened region of the target) and 90 percent of the free length. In the deployed position, the resilient member 590 may exert a force of approximately 8.7 pounds*force, or within a range 4.4 pounds*force and 17.5 pounds*force.

Figure 39:
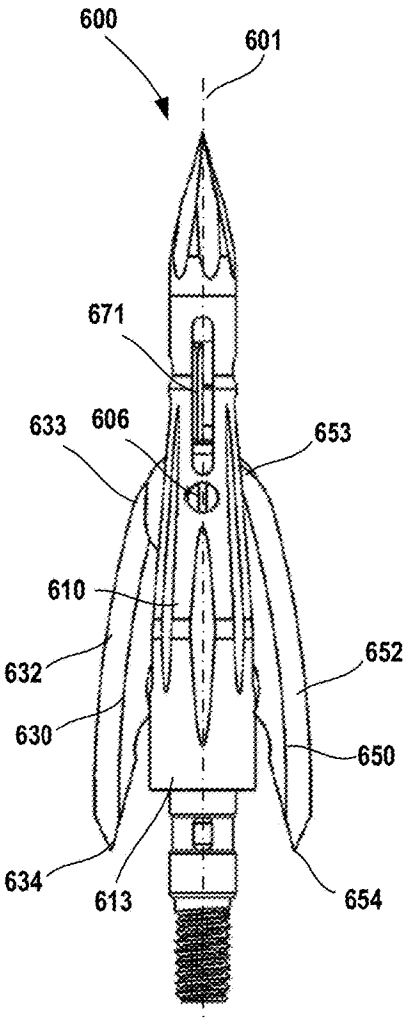
FIG. 39 depicts a front view of the arrowhead of FIG. 38 with the blades in a stowed position, according to aspects described herein.
Figure 38:
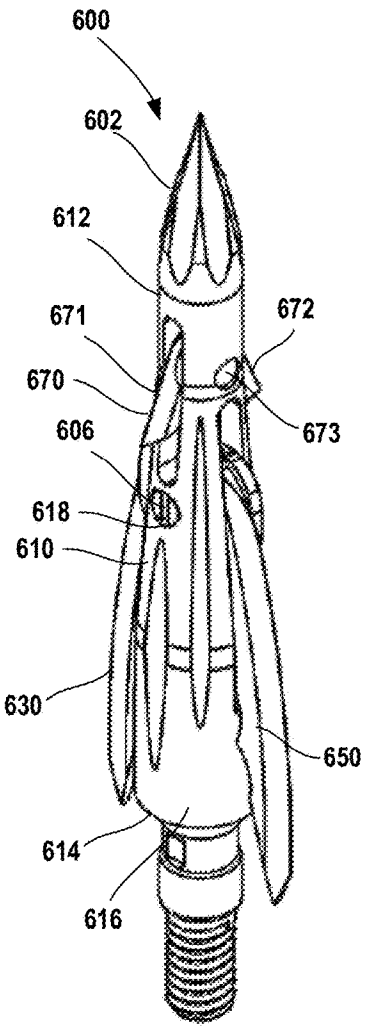
FIG. 38 depicts a perspective view of an alternate exemplary arrowhead of FIG. 1 with the blades in a stowed position, according to aspects described herein.
Figure 40:
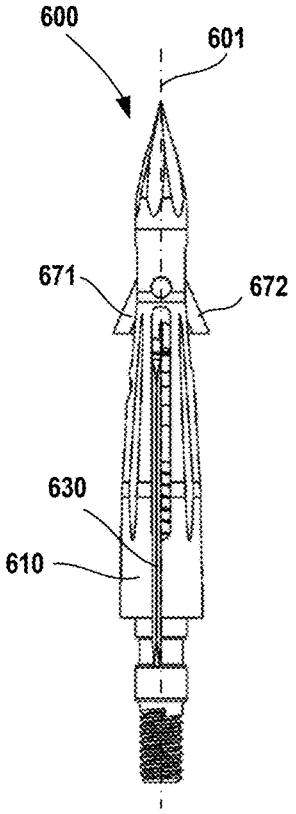
FIG. 40 depicts a side view of the arrowhead of FIG. 38 with the blades in a stowed position, according to aspects described herein.
Figure 41:
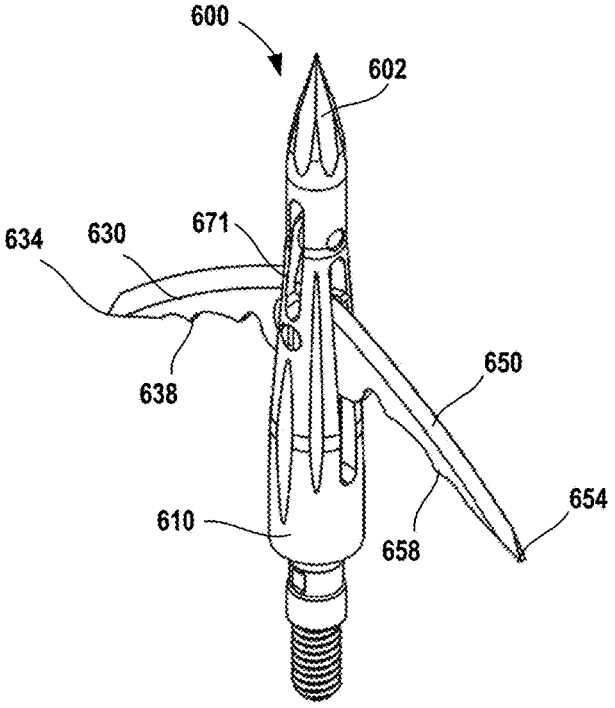
FIG. 41 depicts a perspective view of the arrowhead of FIG. 38 with the blades in a deployed position, according to aspects described herein.
Figure 42:
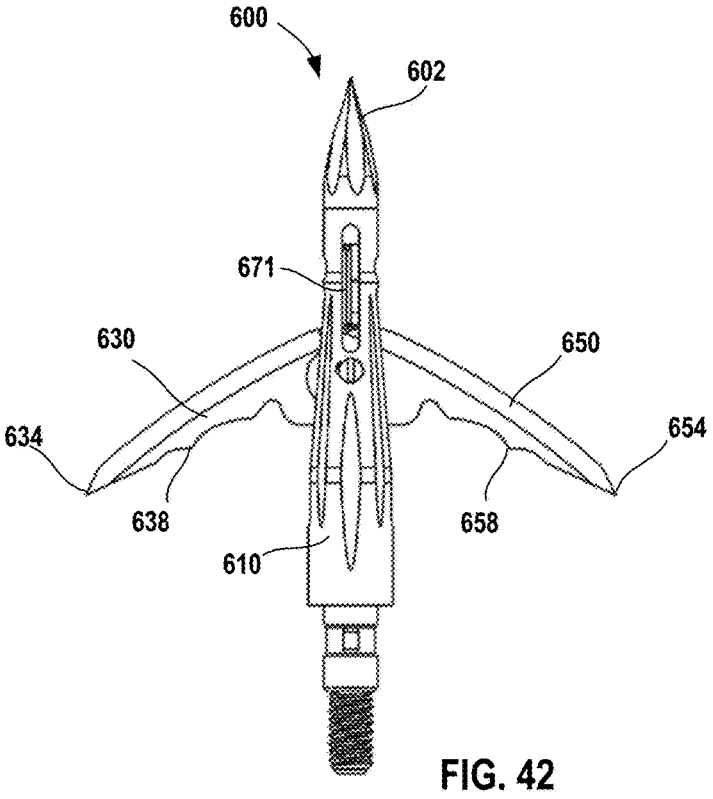
FIG. 42 depicts a front view of the arrowhead of FIG. 41, according to aspects described herein.
Figure 43:
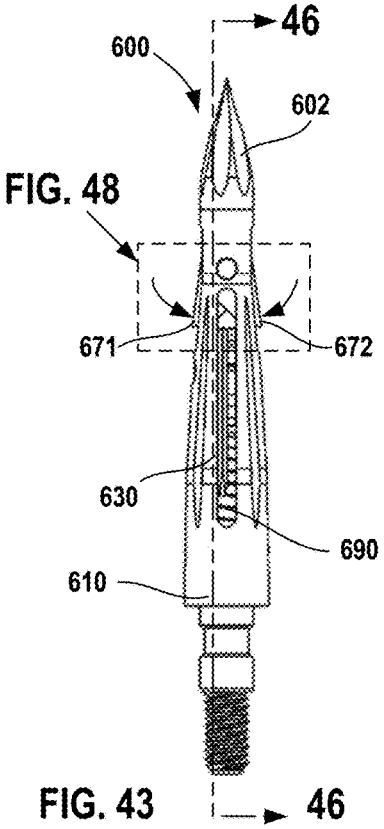
FIG. 43 depicts a side view of the arrowhead of FIG. 41, according to aspects described herein.

FIGS. 38-48 depict an alternative arrowhead 600. The features of arrowhead 600 are referred to using similar reference numerals under the "6xx" series of reference numerals, rather than "6xx" as used in the exemplary arrowhead 100 shown in FIGS. 1-13. Accordingly, certain features of the arrowhead 600 that were already described above with respect to arrowhead 600 of FIGS. 1-13 may be described in lesser detail, or may not be described at all. Arrowhead 600 may have deployable blades 630, 650 that are moved from a stowed position to a deployed position via a trigger mechanism 670. Arrowhead 600 may comprise a first blade 630, a second blade 650, a ferrule 610, and a resilient member 690 that is received within a ferrule cavity 619 located within a ferrule body 616 along a blade pivot pin 606. The arrowhead 600 may be configured such that the blades 630, 650 deploy from a stowed position to a deployed position almost simultaneously to ensure a uniform cut and improve performance of the arrowhead 600. The arrowhead 600 may include a longitudinal axis 601 along a centerline of the arrowhead 600. FIGS. 38-40 illustrate arrowhead 600 with the blades 630, 650 in a stowed position where the blades 630, 650 may contact an outer surface 613 of the ferrule 610, while FIGS. 41-43 illustrates the blades 630, 650 in a deployed position, where the distal ends 634, 654 of the blades 630, 650 are extended away from the outer surface 613 of the ferrule 610 at a distance that is greater than when the blades 630, 650 are in the stowed position. In some examples, the deployed position of the arrowhead 600 may be defined by all of the protuberances 638, 658 of the blades 630, 650 being free of contact with the outer surface 613 of the ferrule 610. The deployed blades 630, 650 may extend to reach a maximum cutting diameter, D, where the maximum cutting diameter is measured as a horizontal distance between the distal ends 634, 654 of the blades 630, 650. In the illustrated example, the arrowhead 600 may include a resilient member 690, such as a compression spring, that allows the blades 630, 650 to fluctuate or change in cutting diameter while penetrating a target, such that each blade 630, 650 may deflect inward independently when contacting a hardened region of a target, such as a bone.

The trigger mechanism 670 may interact with the blades 630, 650 to control the deployment of the blades 630, 650. The trigger mechanism 670 may have an armed position that keeps the blades 630, 650 in a stowed position and an activated position that allows the blades 630, 650 to move to a deployed position. The trigger mechanism 670 may comprise a first trigger member 671 and a second trigger member 672 that are pivotally attached to the ferrule 610 at a trigger pivot axis. In some illustrated examples, the trigger members 671, 672 may be pivotally attached to the ferrule 610 using a trigger pin 673 that extends into a trigger pivot hole located on the ferrule 610. Each trigger member 671, 672 may include a trigger pivot aperture that receives the trigger pin 673, an extension 674, an engaging portion 675, and a channel 676 formed between the extension 674 and the engaging portion 675. Each channel 676 may have a first end near a juncture of the extension 674 and the engaging portion 675 and a second end opposite the first end where the second end is open. The second or open end of each channel 676 may have a greater width than the first end. The extension 674 and the engaging portion 675 may diverge away from each other to form the channel 676. In some examples, each extension 674 may have a cutting portion 678 such that the extensions 674 can act as secondary blades.

The extensions 674 of the trigger members 671, 672 may be oriented generally perpendicular to the blades 630, 650. Thus, the trigger pivot axis may also be oriented generally perpendicular to the blade pivot axis. In addition, the trigger pivot axis may be located closer to the point 602 than the blade pivot axis.

The ferrule 610 may comprise a first end 612, a second end 614, and a ferrule body 616 that extends between the first end 612 and the second end 614. The point 602 may be a separate component fixedly or removably connected to the first end 612. Alternatively, the ferrule 610 may be integrally formed with a point 602 at the first end 612. The ferrule body 616 may also include a blade pivot hole 618 that defines a blade pivot axis and receives the blade pivot pin 606. The blade pivot hole 618 may be centered along the longitudinal axis 601 of the arrowhead 600. In other examples, the blade pivot hole 618 may be offset from the longitudinal axis 601. Optionally, the arrowhead 600 may have a pair of blade pivot holes 618 arranged on each side of the longitudinal axis 601. The ferule body 616 may include two sets or pairs of slots that extend from the outer surface 613 to the ferrule cavity 619. The first pair of slots may allow the blades 630, 650 to move as needed, and a second pair of slots to allow the trigger members 671, 672 to move as needed.

Blade 630 may have a cutting portion 632, which may be located on an exterior edge of the blade 630 with a distal end 634. In addition, blade 630 may include a blade pivot aperture that receives a blade pivot pin 606 that also extends into the blade pivot hole 618. A plurality of protuberances 638 may be arranged on an opposite side from the cutting portion 632. The blade 630 may also include a blade locking geometry 639 that interacts with a blade locking member 680 when the arrowhead 600 is in a stowed position. The blade locking geometry 639 may comprise a convex curved surface. In addition, blade 630 may include a deployment tab 640 near a first end 633 opposite the distal end 634 to assist in the deployment of the blade 630 and a deployment geometry 641 that that interacts with a blade locking member 680 when the arrowhead 600 is in a deployed position. In some examples, the blade 630 may have a guide slot similar to the guide slot 142 of blade 130.

Similarly, blade 650 may have a cutting portion 652, which may be located on an exterior edge of the blade 650 with a distal end 654. In addition, blade 650 may include a blade pivot aperture that receives a blade pivot pin 606 that also extends into the blade pivot hole 618. A plurality of protuberances 658 may be arranged on an opposite side from the cutting portion 652. The blade 650 may also include a blade locking geometry 659 that interacts with a blade locking member 680 when the arrowhead 600 is in a stowed position. The blade locking geometry 659 may comprise a convex curved surface. In addition, blade 650 may include a deployment tab 660 at a first end 653 opposite the distal end 654 to assist in the deployment of the blade 650 and a deployment geometry 661 that that interacts with a blade locking member 680 when the arrowhead 600 is in a deployed position. In some examples, the blade 630 may have a guide slot similar to the guide slot 162 of blade 150.

As shown in FIG. 42, in some examples, a protuberance 638, 658 of each blade 630, 650 may contact an outer surface of the ferrule 610. By having a protuberance 638, 658 contact the outer surface of the ferrule 610, the blades 630, 650 are constrained in one direction such that when the blades 630, 650 are in a stowed position, the blades 630, 650 may only move outward away from the ferrule 610 and prevent any inadvertent deformation of the resilient member 690 to control the direction of force the resilient member 690 will impart onto the blade 630, 650 when the blades 630, 650 are deployed.

Figure 44:
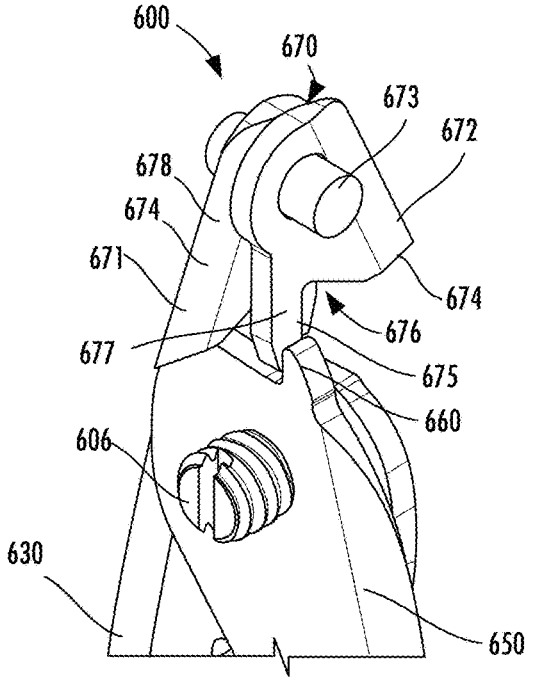
FIG. 44 depicts a partial perspective view of the arrowhead of FIG. 38 with the blades in a stowed position with some components removed for clarity, according to aspects described herein.
Figure 45:
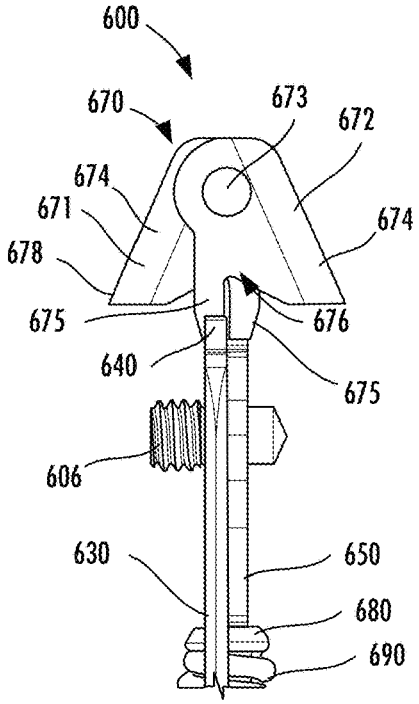
FIG. 45 depicts a partial side view of the arrowhead of FIG. 38 with the blades in a stowed position with some components removed for clarity, according to aspects described herein.
Figure 46:
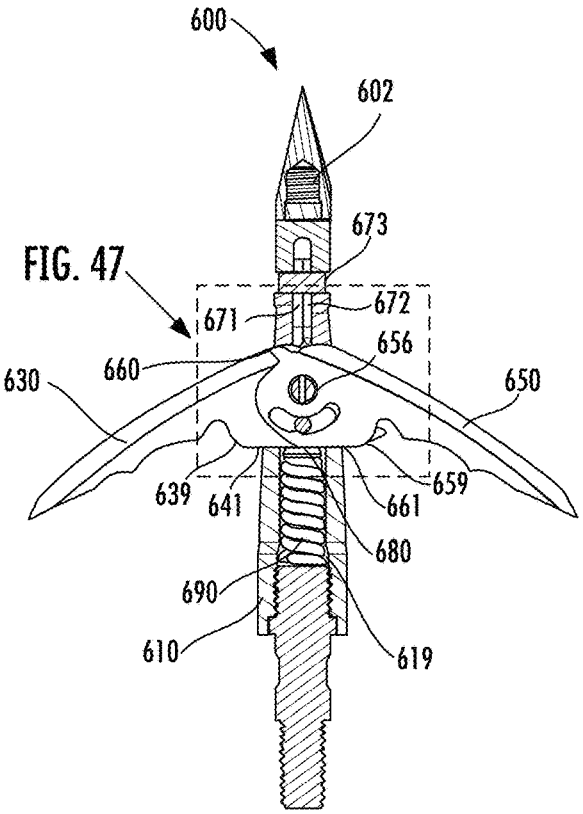
FIG. 46 depicts a front cross-sectional view of the arrowhead of FIG. 43 along line 46-46 with the blades in a deployed position, according to aspects described herein.
Figure 47:
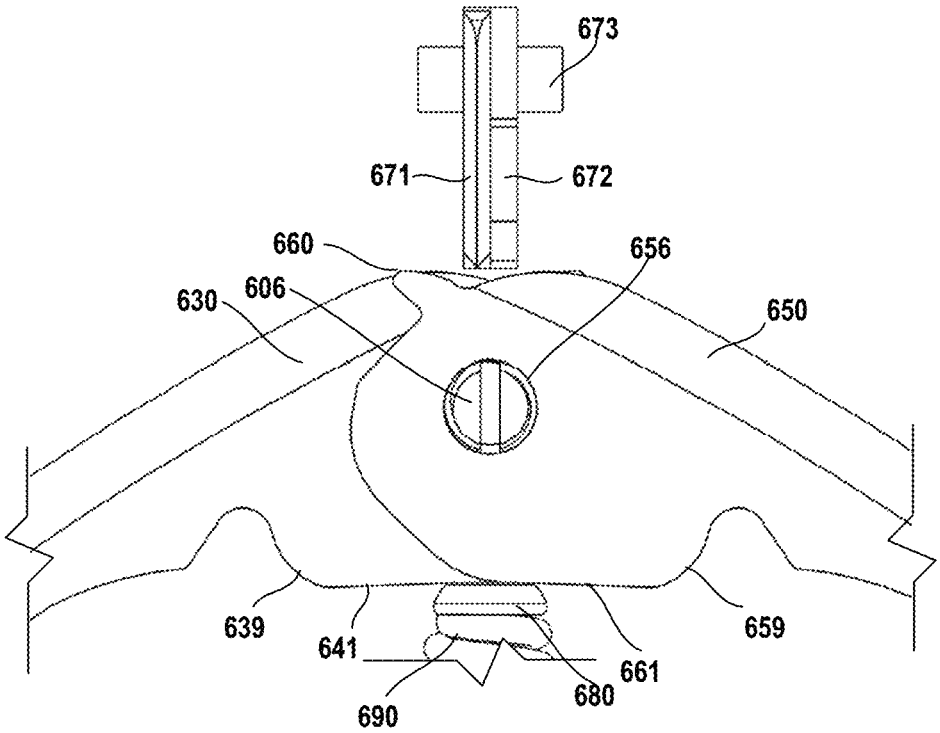
FIG. 47 depicts a partial enlarged view of FIG. 46 with some components removed for clarity, according to aspects described herein.

When the arrowhead 600 is in a stowed position as shown in FIGS. 38-40, the trigger mechanism 670 holds the blades 630, 650. In the stowed position, the engaging portion 675 of each trigger member 671, 672 contacts a deployment tab 640, 660 of each blade 630, 650. As best shown in FIGS. 44-45, a contact surface 677 of a deployment tab 640 may frictionally engage a front surface of the engaging portion 675 of the trigger member 671, and similarly, a contact surface 677 of the deployment tab 660 may frictionally engage a contact surface of the deployment tab 640 of the trigger member 672. The force exerted on the blades 630, 650 by the resilient member 690 helps create a frictional resistance between the contact surfaces 677 of each trigger member 671, 672 and the deployment tabs 640, 660 to hold the blades 630, 650 in a stowed position. In addition, the engaging portions 675 and the corresponding front surfaces of the trigger members 671, 672 may include various elements to increase or decrease the frictional resistance between them when the arrowhead is in a stowed position, such as smoothed surfaces, textured or knurled surfaces, a dimple and detent system (e.g., a protrusion on a contact surface of a corresponding deployment tab 640, 660 may be received within a recess on the front surface of the engaging portion 675 or a recess on a contact surface of a corresponding deployment tab 640, 660 may receive a protrusion on the front surface of the engaging portion 675), an interaction where the engaging portions 675 of the trigger members 671, 672 deform upon contact to increase the force needed to free the trigger members 671, 672 from contact with each other, or other means known to one skilled in the art. A portion of the extension 674 of each trigger member 671, 672 extends outboard of the ferrule 610 when the arrowhead 600 is in a stowed position.

Figure 48:
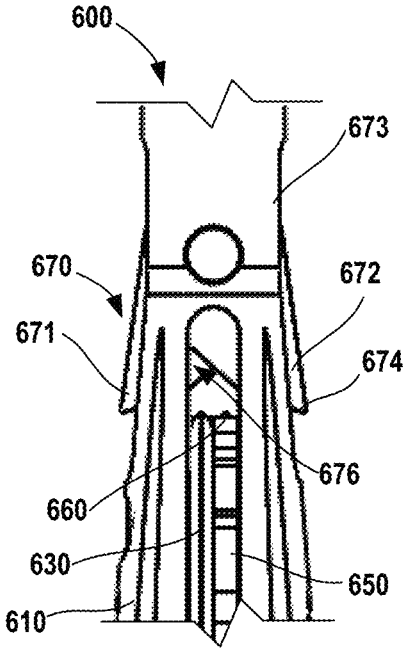
FIG. 48 depicts a partial enlarged view of the arrowhead of FIG. 43, according to aspects described herein.

When the arrowhead 600 contacts a target, an impact force is imparted onto one of or both of the extensions 674 of each trigger member 671, 672 causing one or both extensions 674 to rotate inward as shown in FIGS. 41-43. The impact force overcomes the frictional resistance between the contact surfaces 677 of trigger members 671, 672 and the engaging portions 675 to allow the extensions 674 to rotate inward. As the extensions 674 rotate inward, the engaging portions 675 rotate away from the deployment tabs 640, 660 causing them to be free of contact with the corresponding deployment tab 640, 660. Once the deployment tabs 640, 660 are free of contact with the engaging portions 675, the blades 630, 650 are free to rotate around the blade pivot axis from a stowed position to a deployed position. Thus, the force exerted by the resilient member 690 on the blades 630, 650 causes the blades 630, 650 to rotate from a stowed position to a deployed position. When the blades 630, 650 rotate from a stowed position to a deployed position, the deployment tabs 640, 660 may rotate and pass through the channels 676 in each trigger member 671, 672 as shown in FIGS. 43 and 48. Once deployed, the blades 630, 650 may respond in a similar manner to the other arrowheads 100, 200, 400, 500 disclosed herein such that one or both of the blades 630, 650 may fluctuate or change in cutting diameter while penetrating a target, such that each blade 630, 650 may deflect inward independently when contacting a hardened region of a target, such as a bone.

While the illustrated example shows a trigger mechanism 670 that includes a pair of trigger members 671, 672, in some examples, the trigger mechanism 670 may comprise a single trigger member 671 that has a single engaging portion 675 that engages both blades 630, 650 to keep the arrowhead 600 in a stowed position. In a similar manner to the trigger mechanism 670 with two trigger members 671, 672, once the extension 674 of the single trigger member 671 moves inward, the blades 630, 650 are released to move from a stowed position to a deployed position.

Figure 49:
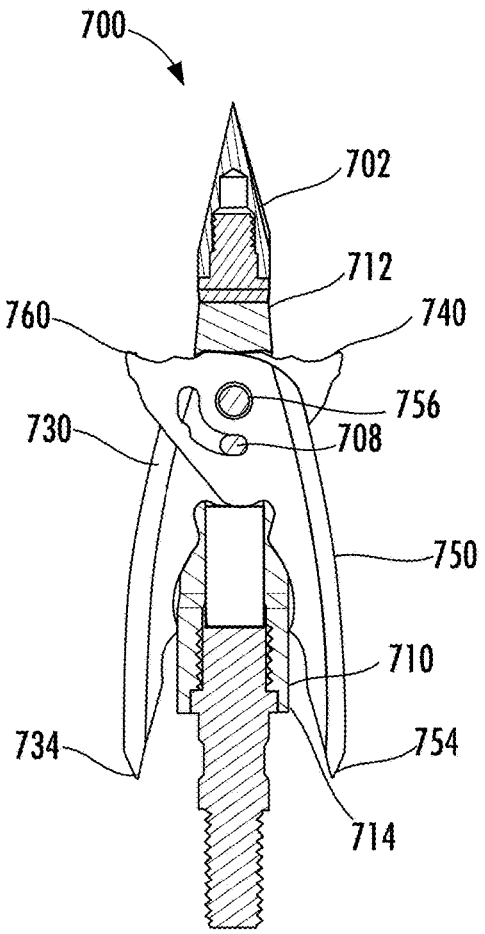
FIG. 49 depicts a cross-sectional front view of an alternate exemplary arrowhead of FIG. 1 with the blades in a stowed position, according to aspects described herein.
Figure 50:
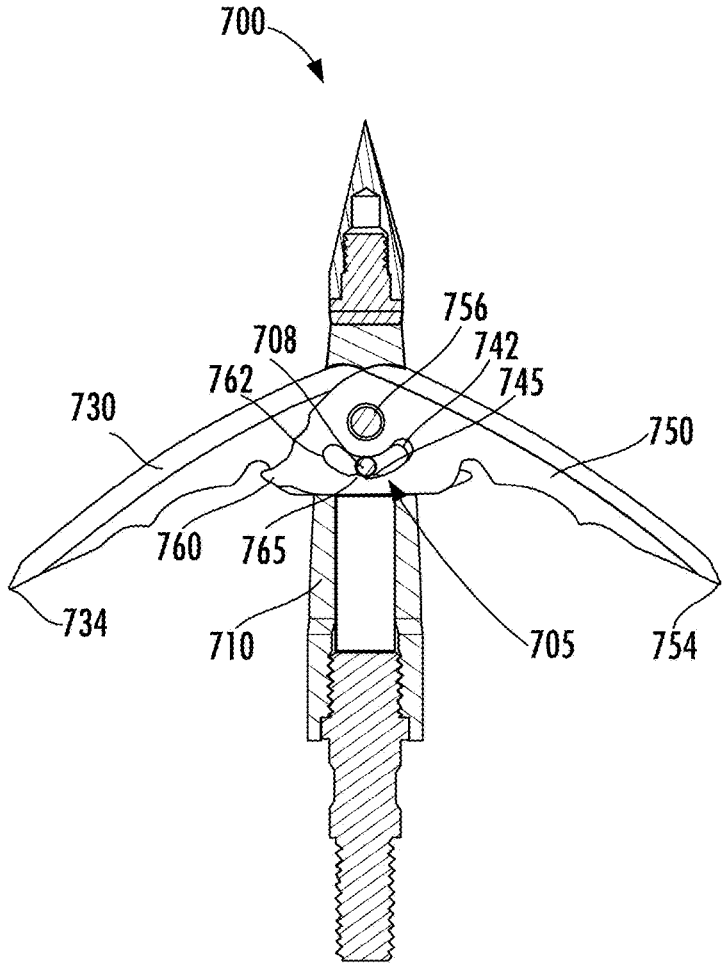
FIG. 50 depicts a cross-sectional front view of the exemplary arrowhead of FIG. 49 with the blades in a deployed position, according to aspects described herein.

FIGS. 49-50 illustrate arrowhead 700. The features of arrowhead 700 are referred to using similar reference numerals under the "7xx" series of reference numerals, rather than "1xx" as used in the exemplary arrowhead 100 shown in FIGS. 1-13. Accordingly, certain features of arrowhead 700 that were already described above with respect to arrowhead 100 of FIGS. 1-13 may be described in lesser detail, or may not be described at all. Arrowhead 700 may be similar to arrowhead 100 except arrowhead 700 does not include a resilient member 190. Each blade 730, 750 may be pivotally connected to the ferrule 710. In addition, each blade 730, 750 may include a deployment member 740, 760 opposite the respective distal end 734, 754 of each blade 730, 750. When the arrowhead 700 contacts a target, each deployment member 740, 760 receives an impact force that causes each deployment member 740, 760 to rotate rearward, which in turn causes the distal ends 734, 754 to rotate forward into a deployed position. When the arrowhead 700 is in the deployed position, the blades 730, 750 may be maintained in a deployed position a locking feature 705 that prevents the blades 730, 750 from rotating rearward toward a stowed position until a force that is greater than a threshold force that may be received by the cutting portions of the blades 730, 750. The tab or locking member may create an interaction between the blades 730, 750 and the ferrule 710 to lock the blades 730, 750 in a deployed position. If a cutting portion of one of the blades 730, 750 receives a force above a threshold force, such as caused by the cutting portion hitting a bone or other hard object in the target, the distal end 734, 754 of the one or more blades 730, 750 receiving the force may cause the distal end 734, 754 to rotate toward the ferrule 710 (i.e., moving toward a stowed position). As a distal end 734, 754 of one of the blades 730, 750 moves toward the ferrule 710, a portion of the corresponding deployment member 740, 760 moves outward outboard of the ferrule 710 where it receives a force caused by the movement of the arrowhead 700 through the target to move the deployment member 740, 760 inward causing the distal end 734, 754 of the blades 730, 750 to move outward again. Thus, allowing the blades 730, 750 to deflect independently when necessary. In some examples, when the blades 730, 750 are in a deployed position, each deployment member 740, 760 may have a portion located outboard the ferrule 710 such that it receives a force from the target to help prevent each blade 730, 750 from moving from a deployed position to a stowed position.

In some examples, each blade 730, 750 may also have a guide slot 742, 762 that receives a guide pin 708 that is also received in a guide pin hole of the ferrule 710. The ferrule 710 may comprise a first end 712, a second end 714. The point 702 may be a separate component fixedly or removably connected to the first end 712. The guide slots 742, 762 may be located below (i.e., closer to the second end 714 of the ferrule 710) and spaced from the blade pivot aperture 756. The guide slots 742, 762 may have a curved shape, where curved shape or arcuate shape that may be centered on the blade pivot aperture 756. Each guide slot 742, 762 may comprise an inboard edge, an outboard surface, and a raised stop surface 745, 765 along the outboard surface. The raised stop surface 745, 765 may hold the guide pin 708 to provide a stop or locking feature 705 to fix the blades 730, 750 in a deployed position until the cutting portion of one or both of the blades 730, 750 receives a force above the threshold force that may overcome the stop 705 to allow the distal ends 734, 754 of the blades 730, 750 to move toward the ferrule 710 to allow one of both of the blades 730, 750 to move around a hardened portion of the target. Alternatively, the locking feature 705 may comprise a frictional interaction between the blades 730, 750, such as a detent and recess arrangement on the blades 730, 750, to lock the blades 730, 750 in a deployed position until the cutting portion of one or both of the blades 730, 750 receives a force above the threshold force that may overcome the stop 705 to allow the distal ends 734, 754 of the blades 730, 750 to move toward the ferrule 710 to allow one of both of the blades 730, 750 to move around a hardened portion of the target. In some examples, once the blades 730, 750 are in a deployed position, an element of the blades 730, 750 may deform or break off to allow an end 734, 754 of one or more of the blades 730, 750 to move back toward the ferrule 710 to allow the arrowhead 700 to move around a hardened portion of the target.

For the avoidance of doubt, the present application includes at least the subject matter described in the following numbered Clauses:

Clause 1. An arrowhead, comprising:

a ferrule that includes a first end, a second end, and a ferrule body extending between the first end and the second end that defines a longitudinal axis, the ferrule body further including a blade pivot hole that defines a blade pivot axis and a ferrule cavity, wherein the blade pivot axis is generally perpendicular to the longitudinal axis;

a resilient member and a blade locking member located within the ferrule cavity, wherein the blade locking member is connected to an upper portion the resilient member;

a first blade having a first cutting portion, wherein the first blade is pivotally attached to the ferrule at the blade pivot axis, wherein the first blade includes a first blade pivot aperture, a first blade locking geometry, and a first rear surface opposite the first cutting portion, wherein the first blade locking geometry includes a convex curved surface;

a second blade having a second cutting portion, wherein the second blade is pivotally attached to the ferrule at the blade pivot axis, wherein the second blade includes a second blade pivot aperture, and a second rear surface opposite the second cutting portion;

wherein the first blade and the second blade are pivotally attached to the ferrule along a blade pivot pin that extends through the first blade pivot aperture, the second blade pivot aperture, and the blade pivot hole;

wherein the first blade and the second blade have a stowed position and a deployed position, wherein the stowed position is defined by a portion of the first rear surface contacting an outer surface of the ferrule;

wherein the blade locking member comprises a concave surface that contacts the first blade locking geometry when the arrowhead is in the stowed position; and wherein the deployed position is defined by the first rear surface being free of contact with the outer surface of the ferrule.

Clause 2. The arrowhead of clause 1, wherein the first rear surface of the first blade includes a first plurality of protuberances that contact the outer surface of the ferrule when the first blade is in the stowed position.

Clause 3. The arrowhead of clause 1, wherein the second rear surface of the second blade includes a second plurality of protuberances that contact the outer surface of the ferrule when the second blade is in the stowed position.

Clause 4. The arrowhead of clause 1, wherein the second blade includes a second blade locking geometry, wherein the second blade locking geometry includes a convex curved surface, and wherein the concave surface of the blade locking member contacts the second blade locking geometry when the arrowhead is in the stowed position.

Clause 5. The arrowhead of clause 1, wherein the first blade includes a first deployment tab, and wherein when the first deployment tab receives a predetermined force, the first deployment tab rotates causing the first blade locking geometry to be free of contact with the blade locking member and both the first blade and the second blade to move to the deployed position.

Clause 6. The arrowhead of clause 1, wherein the resilient member is a compression spring.

Clause 7. The arrowhead of clause 1, wherein the resilient member comprises a first resilient member and a second resilient member, wherein the second resilient member has a nested configuration with the first resilient member such that the first resilient member surrounds a portion of the second resilient member.

Clause 8. The arrowhead of clause 7, wherein the first resilient member is a first compression spring, and the second resilient member is a second compression spring.

Clause 9. The arrowhead of clause 8, wherein the first compression spring has a first free length and the second compression spring has a second free length, wherein the first free length is greater than the second free length.

Clause 10. The arrowhead of clause 1, wherein the resilient member has a first end and a second end opposite the first end, wherein the first end has a first diameter and the second end has a second diameter, and wherein the first diameter is greater than the second diameter.

Clause 11. The arrowhead of clause 10, wherein the resilient member has an outer profile that extends between the first end and the second end, wherein the outer profile of the resilient member tapers linearly from the first end to the second end.

Clause 12. The arrowhead of clause 10, wherein the second diameter is within a range of 70 percent and 85 percent of the first diameter.

Clause 13. The arrowhead of clause 1, wherein the resilient member has a maximum diameter within a range of 70 percent and 95 percent of the diameter of the ferrule cavity, wherein the diameter of the ferrule cavity is measured at a location at an approximate center of a longitudinal length of the resilient member.

Clause 14. The arrowhead of clause 1, wherein the blade pivot axis is positioned along the longitudinal axis of the ferrule.

Clause 15. An arrowhead, comprising:

a ferrule that includes a first end, a second end, and a ferrule body extending between the first end and the second end that defines a longitudinal axis, a first blade having a first cutting portion, wherein the first blade is pivotally attached to the ferrule at a blade pivot axis;

wherein the ferrule includes a ferrule cavity that receives a first resilient member and a second resilient member, wherein the second resilient member has a nested configuration with the first resilient member such that the first resilient member surrounds a portion of the second resilient member; and wherein the first blade has a stowed position and a deployed position; and wherein the first resilient member and second resilient member provide a force to deploy the first blade from the stowed position to the deployed position, and wherein a first distance between a distal end of the first blade and an outer surface of the ferrule is greater when the first blade is in the deployed position than in the stowed position.

Clause 16. The arrowhead of clause 15, wherein the first resilient member is a first compression spring, and the second resilient member is a second compression spring.

Clause 17. The arrowhead of clause 16, wherein the first compression spring has a first free length and the second compression spring has a second free length, wherein the first free length is greater than the second free length.

Clause 18. The arrowhead of clause 15, further comprising a second blade having a second cutting portion, wherein the second blade is pivotally attached to the ferrule at the blade pivot axis; and wherein the force from the first and second resilient members also moves the second blade from the stowed position to the deployed position, and wherein a second distance between a distal end of the second blade and the outer surface of the ferrule is greater in the deployed position than in the stowed position.

Clause 19. The arrowhead of clause 15, wherein the first blade includes a first blade locking geometry, wherein the first blade locking geometry includes a first convex curved surface.

Clause 20. The arrowhead of clause 19, wherein a blade locking member comprises a concave surface that contacts the first blade locking geometry when the arrowhead is in the stowed position.

Clause 21. An arrowhead, comprising:

a ferrule that includes a first end, a second end, and a ferrule body extending between the first end and the second end that defines a longitudinal axis; the ferrule body further including a blade pivot hole that defines a blade pivot axis and a ferrule cavity, wherein the second end of the ferrule is near a stem of the arrowhead;

a resilient member received within the ferrule cavity;

a first blade pivotally attached to the ferrule at the blade pivot axis, wherein the first blade includes a first cutting portion, a first deployment tab, and a first blade locking geometry;

a first trigger member pivotally attached to the ferrule at a trigger pivot axis, wherein the first trigger member includes a first extension, a first engaging portion, and a first channel formed between the first extension and the first engaging portion; and a blade lock member engaged with the resilient member;

wherein the trigger pivot axis is different than the blade pivot axis;

wherein a portion of the first extension extends outboard of the ferrule;

wherein the arrowhead has a stowed position and a deployed position;

wherein when the arrowhead is in the stowed position, the first engaging portion contacts the first deployment tab and the blade lock member contacts the first blade locking geometry; and wherein when the arrowhead is in the deployed position, the first trigger member is free of contact with the first deployment tab.

Clause 22. The arrowhead of clause 21, wherein the first channel of the first trigger member has a first end near a first juncture of the first extension and the first engaging portion and a second end opposite the first end wherein the second end is open and wherein the second end of the first channel has a greater width than the first end.

Clause 23. The arrowhead of clause 21, wherein the trigger pivot axis is positioned closer to the first end of the ferrule than the blade pivot axis.

Clause 24. The arrowhead of clause 21, wherein the trigger pivot axis is oriented generally perpendicular to the blade pivot axis.

Clause 25. The arrowhead of clause 21, wherein a first front surface of the first engaging portion of the first trigger member frictionally engages a first contact surface of the first deployment tab when the arrowhead is in the stowed position.

Clause 26. The arrowhead of clause 25, wherein the first front surface comprises a protrusion that is received within a recess of the first contact surface of the first deployment tab when the arrowhead is in the stowed position.

Clause 27. The arrowhead of clause 25, wherein the first front surface comprises a recess that receives a protrusion of the first contact surface of the first deployment tab when the arrowhead is in the stowed position.

Clause 28. The arrowhead of clause 21, wherein the arrowhead moves from the stowed position to the deployed position when the first extension contacts a target causing the first trigger member to rotate inward around the trigger pivot axis causing the first engaging portion to move away from the first deployment tab.

29. The arrowhead of clause 28, wherein when the arrowhead moves from the stowed position to the deployed position, the first deployment tab moves through the first channel.

30. The arrowhead of clause 21, wherein the first extension and the first engaging portion diverge away from each other to form the first channel.

31. The arrowhead of clause 21, further comprising:

a second blade pivotally attached to the ferrule at the blade pivot axis, wherein the second blade includes a second cutting portion, a second deployment tab, and a second blade locking geometry; and a second trigger member pivotally attached to the ferrule at the trigger pivot axis, wherein the second trigger member includes a second extension, a second engaging portion, and a second channel formed between the second extension and the second engaging portion;

wherein when the arrowhead is in the stowed position, the second engaging portion contacts the second deployment tab and the blade lock member contacts the second blade locking geometry; and wherein when the arrowhead is in the deployed position, the second trigger member is free of contact with the second deployment tab.

Clause 32. The arrowhead of clause 31, wherein the first blade and the second blade are pivotally attached to the ferrule by a blade pivot pin that extends through a first blade pivot aperture located on the first blade, a second blade pivot aperture located on the second blade, and the blade pivot hole.

Clause 33. The arrowhead of clause 31, wherein the first trigger member and the second trigger member are pivotally attached to the ferrule by a trigger pin that extends through a first trigger pivot aperture located on the first trigger member, a second trigger pivot aperture located on the second trigger member, and a trigger pivot hole located on the ferrule.

Clause 34. The arrowhead of clause 21, wherein the trigger pivot axis is positioned along the longitudinal axis of the ferrule.

Clause 35. The arrowhead of clause 21, wherein the first extension has a cutting portion.

Clause 36. The arrowhead of clause 21, wherein the resilient member comprises a compression spring, and wherein the compression spring has a first end and a second end opposite the first end, wherein the first end has a first diameter and the second end has a second diameter, and wherein the first diameter is greater than the second diameter.

Clause 37. The arrowhead of clause 21, wherein the resilient member comprises a first compression spring and a second compression spring, wherein the second compression spring is nested within the first compression spring.

Clause 38. An arrowhead, comprising:

a ferrule that includes a first end, a second end, and a ferrule body extending between the first end and the second end that defines a longitudinal axis, a first blade having a first cutting portion; wherein the first blade is pivotally attached to the ferrule at a blade pivot axis;

wherein the ferrule includes a ferrule cavity that receives a resilient member, wherein the resilient member has a first end and a second end opposite the first end, wherein the first end has a first diameter and the second end has a second diameter, and wherein the first diameter is greater than the second diameter; and wherein the first blade has a stowed position and a deployed position; and wherein the resilient member provides a force to deploy the first blade from the stowed position to the deployed position, and wherein a first distance between a distal end of the first blade and an outer surface of the ferrule is greater in the deployed position than in the stowed position.

Clause 39. The arrowhead of clause 38, wherein the resilient member has an outer profile that extends between the first end and the second end, wherein the outer profile of the resilient member tapers linearly from the first end to the second end.

Clause 40. The arrowhead of clause 38, wherein the second diameter is within a range of 70 percent and 85 percent of the first diameter.

Clause 41. An arrowhead, comprising:

a ferrule that includes a first end, a second end, and a ferrule body extending between the first end and the second end that defines a longitudinal axis; the ferrule body further including a blade pivot hole that defines a blade pivot axis and a ferrule cavity;

a resilient member received within the ferrule cavity;

a first blade having a first cutting portion; wherein the first blade is pivotally attached to the ferrule at the blade pivot axis, wherein the first blade includes a first blade pivot aperture, a first guide slot, a first plurality of protuberances on a side opposite the first cutting portion, and a first blade locking geometry;

a second blade having a second cutting portion; wherein the second blade is pivotally attached to the ferrule at the blade pivot axis, wherein the second blade includes a second blade pivot aperture, a second guide slot, a second plurality of protuberances on a side opposite the first cutting portion, and a second blade locking geometry;

a blade lock member engaged with the resilient member, the first blade locking geometry, and the second blade locking geometry, wherein the first blade and the second blade have a stowed position and a deployed position, wherein the stowed position is defined by a protuberance of the first plurality of protuberances contacting an outer surface of the ferrule and a protuberance of the second plurality of protuberances contacting the outer surface of the ferrule; and wherein the deployed position is defined by all of the protuberances of the first plurality of protuberances being free of contact with the outer surface of the ferrule.

Clause 42. The arrowhead of clause 41, wherein the first blade and the second blade are pivotally attached to the ferrule along a blade pivot pin that extends through the first blade pivot aperture, the second blade pivot aperture, and the blade pivot hole.

Clause 43. The arrowhead of clause 41, wherein the blade pivot axis is positioned along the longitudinal axis of the ferrule.

Clause 44. The arrowhead of clause 41, wherein the resilient member has a maximum diameter that is within a range of 70 percent and 95 percent of the diameter of the ferrule cavity, wherein the diameter of the ferrule cavity is measured at a location at an approximate longitudinal length of the resilient member.

Clause 45. The arrowhead of clause 41, wherein the blade locking member comprises a concave surface that contacts the first blade locking geometry and the second blade locking geometry, wherein the first blade locking geometry and the second blade locking geometry comprises a convex curved surface.

Clause 46. The arrowhead of clause 41, wherein the first blade includes a third guide slot, wherein the third guide slot is positioned closer to the first end of the ferrule and the first guide slot is closer to the second end of the ferrule.

Clause 47. The arrowhead of clause 46, wherein when a guide pin is received in the first guide slot of the first blade, the deployed position defines a first maximum diameter.

Clause 48. The arrowhead of clause 47, wherein the guide pin is received in the third guide slot of the first blade, the deployed position defines a second maximum diameter, wherein the first maximum diameter is different than the second maximum diameter.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. An arrowhead, comprising:

a ferrule that includes a first end, a second end, and a ferrule body extending between the first end and the second end that defines a longitudinal axis, the ferrule body further including a blade pivot hole that defines a blade pivot axis and a ferrule cavity, wherein the blade pivot axis is generally perpendicular to the longitudinal axis;

a resilient member and a blade locking member located within the ferrule cavity, wherein the blade locking member is connected to an upper portion the resilient member;

a first blade having a first cutting portion, wherein the first blade is pivotally attached to the ferrule at the blade pivot axis, wherein the first blade includes a first blade pivot aperture, a first blade locking geometry, and a first rear surface opposite the first cutting portion, wherein the first blade locking geometry includes a convex curved surface;

a second blade having a second cutting portion, wherein the second blade is pivotally attached to the ferrule at the blade pivot axis, wherein the second blade includes a second blade pivot aperture, and a second rear surface opposite the second cutting portion;

wherein the first blade and the second blade are pivotally attached to the ferrule along a blade pivot pin that extends through the first blade pivot aperture, the second blade pivot aperture, and the blade pivot hole;

wherein the first blade and the second blade have a stowed position and a deployed position, wherein the stowed position is defined by a portion of the first rear surface contacting an outer surface of the ferrule;

wherein the blade locking member comprises a concave surface that contacts the first blade locking geometry when the arrowhead is in the stowed position; and wherein the deployed position is defined by the first rear surface being free of contact with the outer surface of the ferrule.

2. The arrowhead of claim 1, wherein the first rear surface of the first blade includes a first plurality of protuberances that contact the outer surface of the ferrule when the first blade is in the stowed position, and wherein the second rear surface of the second blade includes a second plurality of protuberances that contact the outer surface of the ferrule when the second blade is in the stowed position.

3. The arrowhead of claim 1, wherein the second blade includes a second blade locking geometry, wherein the second blade locking geometry includes a convex curved surface, and wherein the concave surface of the blade locking member contacts the second blade locking geometry when the arrowhead is in the stowed position.

4. The arrowhead of claim 1, wherein the first blade includes a first deployment tab, and wherein when the first deployment tab receives a predetermined force, the first deployment tab rotates causing the first blade locking geometry to be free of contact with the blade locking member and both the first blade and the second blade to move to the deployed position.

5. The arrowhead of claim 1, wherein the resilient member is a compression spring.

6. The arrowhead of claim 1, wherein the resilient member comprises a first resilient member and a second resilient member, wherein the second resilient member has a nested configuration with the first resilient member such that the first resilient member surrounds a portion of the second resilient member.

7. The arrowhead of claim 6, wherein the first resilient member is a first compression spring, and the second resilient member is a second compression spring.

8. The arrowhead of claim 7, wherein the first compression spring has a first free length and the second compression spring has a second free length, wherein the first free length is greater than the second free length.

9. The arrowhead of claim 1, wherein the resilient member has a first end and a second end opposite the first end, wherein the first end has a first diameter and the second end has a second diameter, and wherein the first diameter is greater than the second diameter.

10. The arrowhead of claim 9, wherein the resilient member has an outer profile that extends between the first end and the second end, wherein the outer profile of the resilient member tapers linearly from the first end to the second end.

11. The arrowhead of claim 1, wherein the resilient member has a maximum diameter within a range of 70 percent and 95 percent of a diameter of the ferrule cavity, wherein the diameter of the ferrule cavity is measured at a location at an approximate center of a longitudinal length of the resilient member.

12. An arrowhead, comprising:

a ferrule that includes a first end, a second end, and a ferrule body extending between the first end and the second end that defines a longitudinal axis;

a first blade having a first cutting portion; wherein the first blade is pivotally attached to the ferrule at a blade pivot axis;

wherein the ferrule includes a ferrule cavity that receives a resilient member, wherein the resilient member has a first end and a second end opposite the first end, wherein the first end has a first diameter and the second end has a second diameter, and wherein the first diameter is greater than the second diameter; and wherein the first blade has a stowed position and a deployed position; and wherein the resilient member provides a force to deploy the first blade from the stowed position to the deployed position, and wherein a first distance between a distal end of the first blade and an outer surface of the ferrule is greater in the deployed position than in the stowed position.

13. The arrowhead of claim 12, wherein the resilient member has an outer profile that extends between the first end and the second end, wherein the outer profile of the resilient member tapers linearly from the first end to the second end.

14. The arrowhead of claim 12, wherein the second diameter is within a range of 70 percent and 85 percent of the first diameter.

* * * * *